US011918104B2

(12) United States Patent
Lau

(10) Patent No.: US 11,918,104 B2
(45) Date of Patent: Mar. 5, 2024

(54) DESKTOP RISER

(71) Applicant: Colebrook Bosson & Saunders (Products) Limited, London (GB)

(72) Inventor: Alex Lau, London (GB)

(73) Assignee: Colebrook Bosson & Saunders (Products) Limited, London (GB)

( * ) Notice: Subject to any disclaimer, the term of this patent is extended or adjusted under 35 U.S.C. 154(b) by 0 days.

(21) Appl. No.: 17/765,395

(22) PCT Filed: Oct. 10, 2019

(86) PCT No.: PCT/GB2019/052888
§ 371 (c)(1),
(2) Date: Mar. 30, 2022

(87) PCT Pub. No.: WO2021/069852
PCT Pub. Date: Apr. 15, 2021

(65) Prior Publication Data
US 2022/0369806 A1 Nov. 24, 2022

(51) Int. Cl.
*A47B 21/00* (2006.01)
*A47B 9/16* (2006.01)
*A47B 21/03* (2006.01)

(52) U.S. Cl.
CPC ..... *A47B 21/0314* (2013.01); *A47B 9/16* (2013.01)

(58) Field of Classification Search
CPC ..... A47B 21/0314; A47B 21/02; A47B 9/16; A47B 9/02; A47B 9/00; A47B 3/02;
(Continued)

(56) References Cited

U.S. PATENT DOCUMENTS 165,885 A 7/1875 Sloan
262,206 A * 8/1882 Care
(Continued)

FOREIGN PATENT DOCUMENTS

CA 1229647 A 11/1987
CN 101849736 B 4/2012
(Continued)

OTHER PUBLICATIONS

International Search Report with Written Opinion for related Application No. PCT/GB2019/052888 dated Jan. 24, 2020 (12 Pages).
(Continued)

*Primary Examiner* — Janet M Wilkens
(74) *Attorney, Agent, or Firm* — MICHAEL BEST & FRIEDRICH LLP

(57) ABSTRACT

A height adjustable work surface includes a platform and a height adjustment assembly moveably connected to the platform. A leg assembly is connected to the height adjustment assembly and moveably connected to the platform. The leg assembly is moveable between a raised position, a lowered position, and at least one intermediate position. A locking assembly is moveably connected to the platform. The locking assembly is configured to engage the height adjustment assembly to selectively secure the leg assembly in the raised position, the lowered position, and the at least one intermediate position.

18 Claims, 27 Drawing Sheets

(58) Field of Classification Search
CPC ..... A47B 2003/045; A47B 2003/025; A47B 2200/0036; A47B 2200/0042; A47B 2200/06; A63B 21/4035; A63B 2225/68; D06F 81/04
USPC ..... 108/96, 145–147, 136, 50.11, 118–120, 108/42
See application file for complete search history.

(56) References Cited

U.S. PATENT DOCUMENTS

| | | | | |
|---|---|---|---|---|
| 403,652 | A * | 5/1889 | Dlck | |
| 2,814,541 | A | 11/1957 | Derman | |
| 4,662,286 | A | 5/1987 | Barabas | |
| 8,671,853 | B2 | 3/2014 | Flaherty | |
| 9,055,810 | B2 | 6/2015 | Flaherty | |
| 9,113,703 | B2 | 8/2015 | Flaherty | |
| 9,277,809 | B2 | 3/2016 | Flaherty et al. | |
| 9,289,058 | B2 | 3/2016 | Flaherty | |
| 9,326,598 | B1 | 5/2016 | West et al. | |
| D771,981 | S | 11/2016 | Flaherty et al. | |
| D771,982 | S | 11/2016 | Flaherty et al. | |
| 9,554,644 | B2 | 1/2017 | Flaherty et al. | |
| D781,617 | S | 3/2017 | Flaherty et al. | |
| D781,618 | S | 3/2017 | Flaherty et al. | |
| D781,619 | S | 3/2017 | Flaherty et al. | |
| D784,050 | S | 4/2017 | Flaherty et al. | |
| D785,375 | S | 5/2017 | Flaherty et al. | |
| D785,386 | S | 5/2017 | Flaherty et al. | |
| D785,989 | S | 5/2017 | Flaherty et al. | |
| 9,635,929 | B1 | 5/2017 | Wu | |
| D802,405 | S | 11/2017 | Chang et al. | |
| 9,808,080 | B2 | 11/2017 | Chung | |
| D804,862 | S | 12/2017 | Flaherty et al. | |
| 10,092,089 | B1 * | 10/2018 | Yuan | A47B 3/002 |
| 2013/0145972 | A1 | 6/2013 | Knox et al. | |
| 2015/0272316 | A1 | 10/2015 | Flaherty | |
| 2015/0289641 | A1 | 10/2015 | Ergun et al. | |
| 2016/0286951 | A1 | 10/2016 | Chung et al. | |
| 2017/0095072 | A1 | 4/2017 | Flaherty et al. | |
| 2017/0354245 | A1 | 12/2017 | Martin et al. | |
| 2018/0146775 | A1 | 5/2018 | You et al. | |
| 2018/0255919 | A1 | 9/2018 | Swartz et al. | |
| 2020/0359782 | A1 * | 11/2020 | Ballendat | A47B 9/12 |
| 2020/0375351 | A1 * | 12/2020 | Xiang | B66F 7/065 |

FOREIGN PATENT DOCUMENTS

| | | | |
|---|---|---|---|
| CN | 205164022 | * | 4/2016 |
| CN | 205597471 U | | 9/2016 |
| CN | 107048694 A | | 8/2017 |
| CN | 109996466 A | | 7/2019 |
| CN | 210433048 | * | 5/2020 |
| CN | 113068920 | * | 7/2021 |
| DE | 102006045447 | * | 11/2007 |
| DE | 102009003723 A1 | | 10/2010 |
| EP | 3001929 A1 | | 4/2016 |
| GB | 298772 A | | 10/1928 |
| GB | 2575456 | * | 1/2020 |
| KR | 201703423 U | | 10/2017 |

OTHER PUBLICATIONS

Extended Search Report issued from the European Patent Office for related Application No. 15161122.5 dated Jun. 1, 2015 (7 Pages).
Chinese Patent Office Action for Application No. 201980101261.3 dated May 8, 2023 (32 pages including English translation).

* cited by examiner

DESKTOP RISER

FIELD

Various exemplary embodiments relate to height adjustable work surfaces.

BACKGROUND

Modern workplace environments and work stations, as well as the demands for mobility and body positioning are vastly changed from earlier workplaces, where desks and chairs were provided to support workers in typically upright seating postures. Modern workplaces are adapting both sitting and standing worker positions allowing user mobility and range of motion to facilitate job tasks.

Providing the option to either sit or stand at a workstation can allow a user to alternate working positions, preventing injury due to being set in a specific position over an entire day. While workstations (e.g., tables or desks) with a raise and lower mechanism are available, these can be expensive and are not ideal for each environment. Convertible platforms that are placed on top of a user's standard sitting desk are also available, however these are designed for stationary use, decreasing their flexibility and flexibility in the workplace environment.

SUMMARY

A height adjustable work surface includes a platform and a height adjustment assembly moveably connected to the platform. A leg assembly is connected to the height adjustment assembly and moveably connected to the platform. The leg assembly is moveable between a raised position, a lowered position, and at least one intermediate position. A locking assembly is moveably connected to the platform. The locking assembly is configured to engage the height adjustment assembly to selectively secure the leg assembly in the raised position, the lowered position, and the at least one intermediate position.

In one aspect of the invention, the platform includes a main body having a base and a tray recessed from at least a portion of the base, and wherein at least a portion of the height adjustment mechanism is positioned between the tray and the base. The platform may include an inner cover positioned over the tray and wherein an outer cover is positioned over the base. In another aspect of the invention, the platform has a height that reduces toward the user.

In another aspect of the invention, the leg assembly includes a first leg and a second leg and wherein the height adjustment assembly includes a first slider connected to the first leg and a second slider connected to the second leg. The first slider may include a first set of teeth and the second slider may include a second set of teeth configured to align with the first set of teeth. The locking assembly may include a third set of teeth configured to engage the first set of teeth and the second set of teeth to secure the leg assembly in a selected position. The first set of teeth and the second set of teeth may be angled toward a distal portion of the platform and the third set of teeth may be angled toward a proximal portion of the platform. The first slider and the second slider may translate relative to the platform. The first leg may be rotatably connected to the first slider and the second leg may be rotatably connected to the second slider. A first biasing mechanism may be attached to the platform at a first end and attached to the first slider at a second end, and a second biasing mechanism may be attached to the platform at a first end and attached to the second slider at a second end. The first biasing mechanism and the second biasing mechanism may bias the leg assembly to the raised position. The first slider may be positioned on top of the second slider.

In another aspect of the invention, the leg assembly includes an H-leg and a split leg. In another aspect of the invention, a link is rotatably connected to the leg assembly and rotatably connected to the platform, and the link is configured to support the platform through movement of the leg assembly, and the height adjustable work surface further comprises a torsion spring positioned in the leg assembly and connected to a spring bracket, the link is rotatably fixed to the spring bracket, and the torsion spring is configured to bias the link toward the raised position.

In another aspect of the invention, the locking assembly includes a first arm rotatably connected to the platform and a second arm rotatably connected to the platform. The locking assembly may include a first biasing mechanism biasing the first arm to a locked position and a second biasing mechanism biasing the second arm to a locked position.

In another aspect of the invention, the height adjustable work surface further comprises a lower position lock configured to releasably secure the leg assembly inside of the platform in the lowered position. The lower position lock may include a protrusion extending from the leg assembly and recessed tab formed in the locking assembly, and the protrusion may include a hook configured to releasably engage the recessed tab.

In another aspect of the invention, the leg assembly is positioned in a cavity in the platform when the leg assembly is in the lowered position. In another aspect of the invention, the height adjustable work surface further comprises a foot pivotally connected to the leg assembly.

BRIEF DESCRIPTION OF THE DRAWINGS

The aspects and features of various exemplary embodiments will be more apparent from the description of those exemplary embodiments taken with reference to the accompanying drawings.

FIG. 9 is top perspective view of the height adjustable work surface with the platform see-through.

DETAILED DESCRIPTION OF EXEMPLARY EMBODIMENTS

Figure 3:
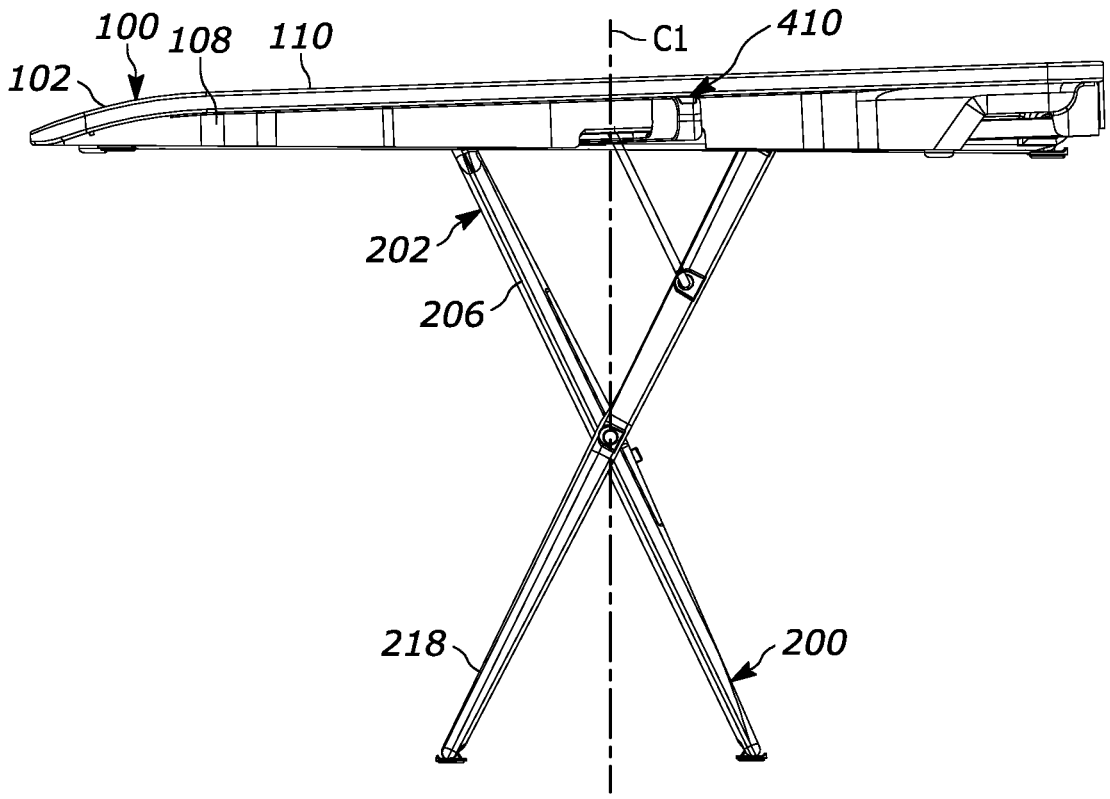
FIG. 3 is side view of the height adjustable work surface in a raised position.
Figure 4:
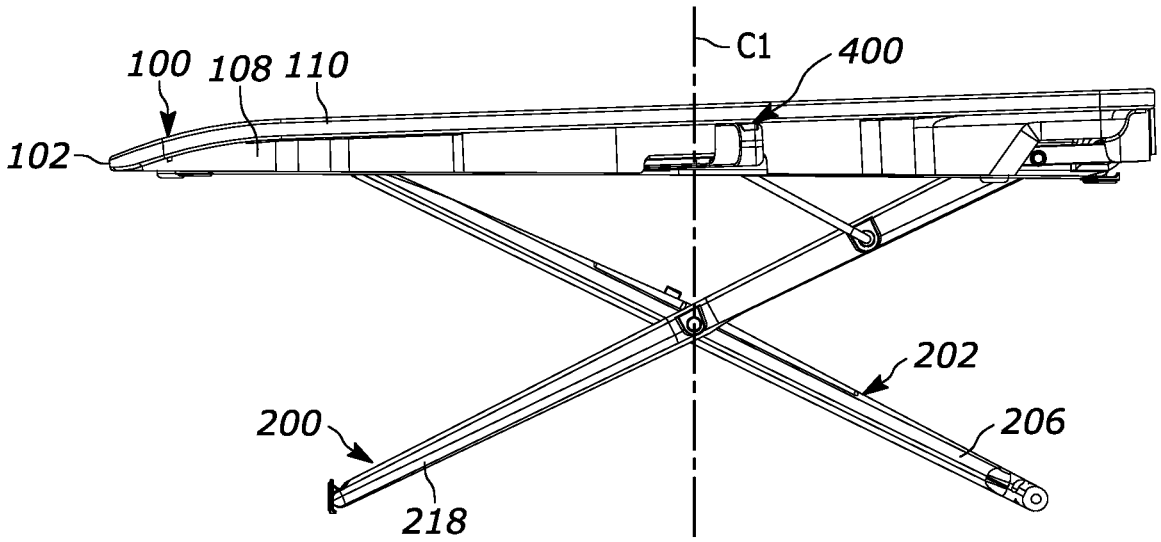
FIG. 4 is a side view of the height adjustable work surface in an intermediate position.

In accordance with various exemplary embodiments, a height adjustable desktop riser work surface includes a platform 100, a leg assembly 200, a height adjustment assembly 300, and a locking assembly 400. The desktop riser is configured to be positioned on a horizontal surface, such as an existing desk or table. The platform forms a surface to support a user's work material (e.g., keyboards, computers, papers, etc.) between a raised, standing position (FIGS. 1-3), a lowered, desk level position (FIGS. 5 and 6), and a number of intermediate positions (e.g., FIG. 4) as desired. The desktop riser can be configured so that the leg structure is always aligned with a midpoint of the platform C1 as it is raised and lowered, preventing the desktop riser from cantilevering out toward the user. For example, the midpoint or center of mass of the platform 100 can be aligned with a pivotal connection in the leg assembly 200 through which the legs are raised and lowered.

Figure 5:
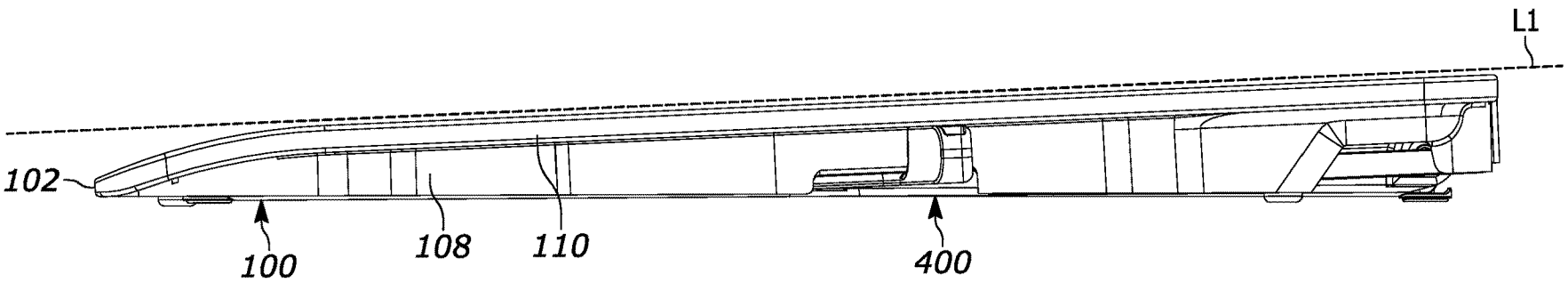
FIG. 5 is a side view of the height adjustable work surface in a lowered position.
Figure 6:
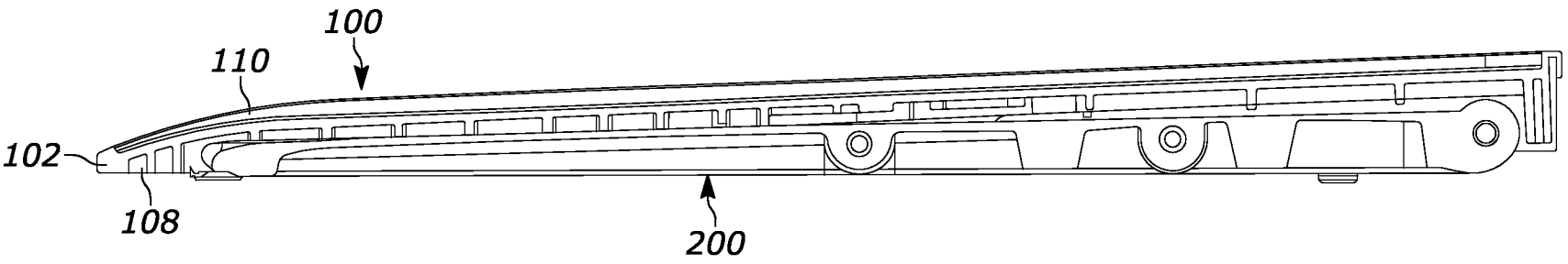
FIG. 6 is a sectional view of FIG. 5 showing the leg assembly positioned in the platform.

As best shown in the lowered position of FIG. 5, top or working surface of the platform 100 slopes downwardly toward the user. Stated another way, the height of the platform 100 decreases toward the user. For example, the height of the platform 100 slopes toward the support surface from the rear to the front of the platform along a line L1. In an exemplary embodiment the height of the platform 100 has a 2 degree angle toward the user. The slope of the platform 100 working surface reduces the height/thickness at the front edge of the platform to minimize the user's need to raise their arms higher than necessary and to avoid a pressure points at the edge of the platform 100. The platform 100 also can include a downward radiused front edge detail, further reducing any potential pressure points on the user's forearms. In the lowered position, the leg assembly 200 is tucked into a cavity in the platform 100 to provide a low profile in appearance and use.

Figure 1:
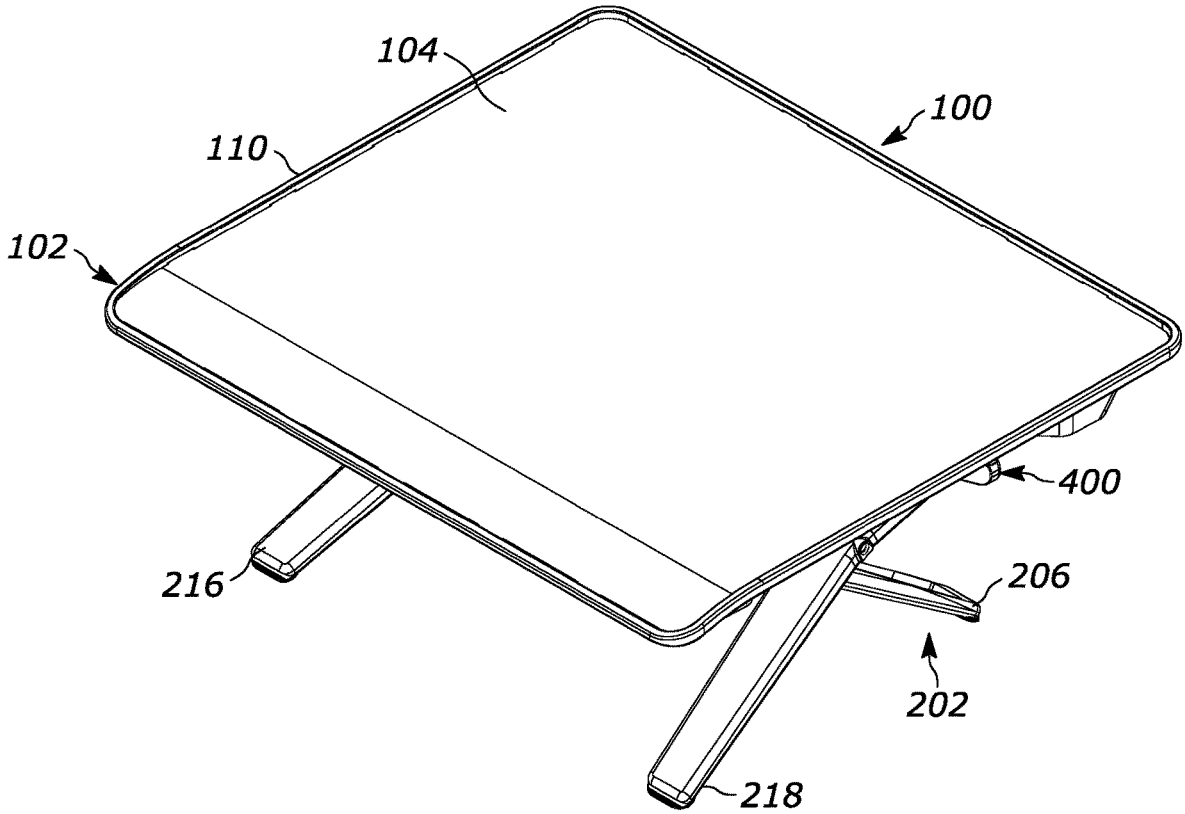
FIG. 1 is a top perspective view of a height adjustable work surface.
Figure 2:
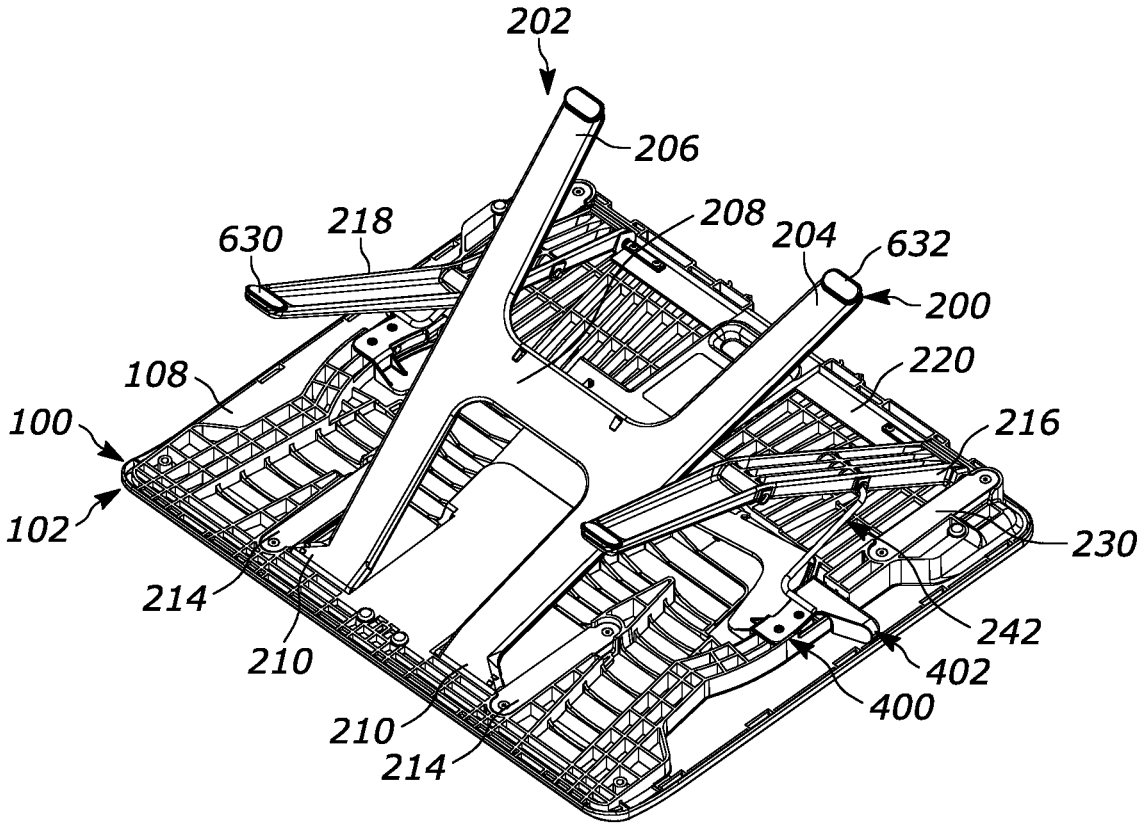
FIG. 2 is a bottom perspective view of the height adjustable work surface.
Figure 7:
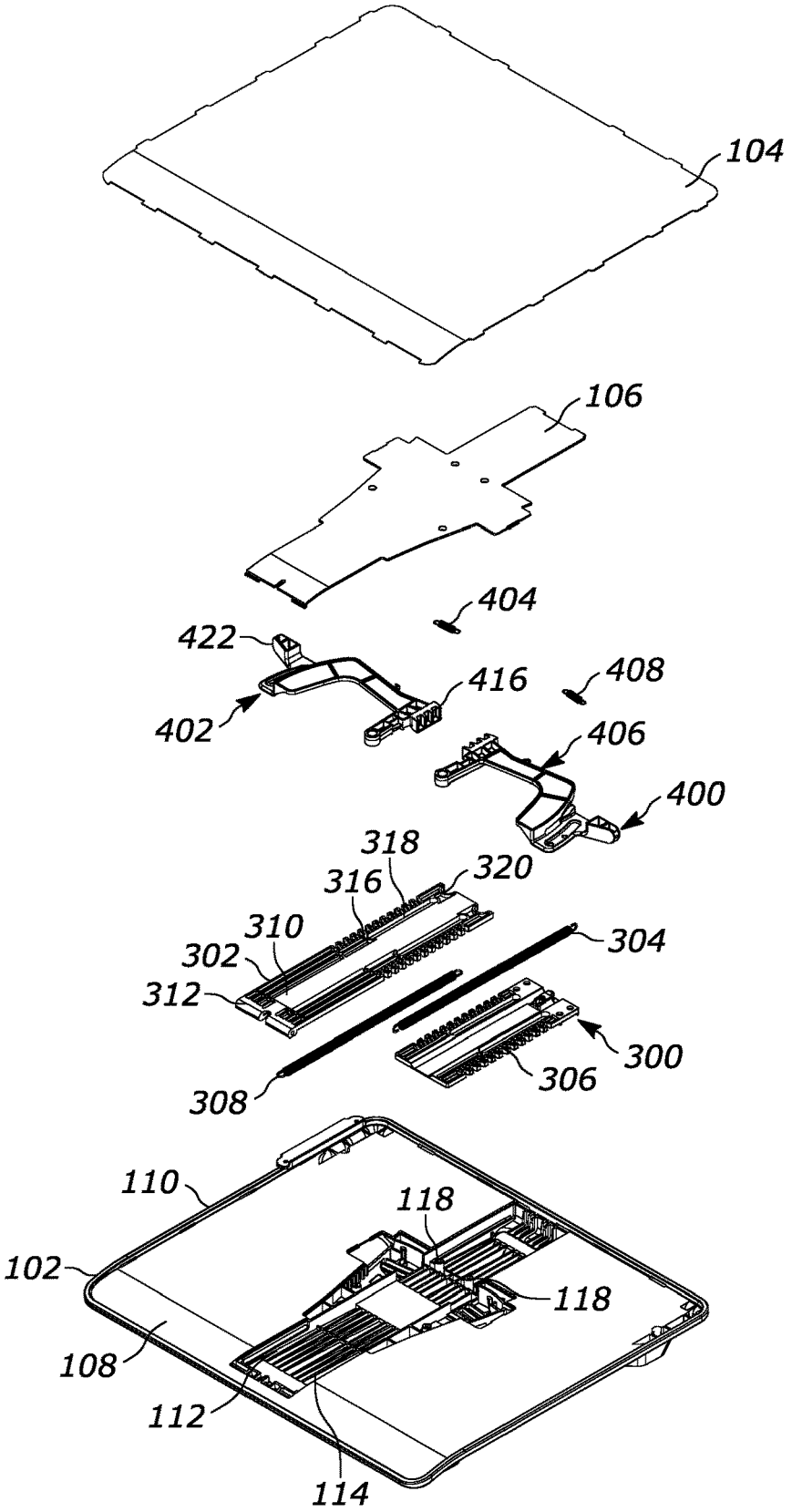
FIG. 7 is a partial exploded view of the height adjustable work surface showing parts of the platform, height adjustment assembly and locking assembly.

As best shown in FIGS. 1, 2, and 7, the platform 100 can include a main body 102, an outer cover 104, and an inner cover 106. The main body 102 includes a base 108 and an outer rim 110 raised from and surrounding at least a portion of the base 108. A central opening 112 is formed in the base 108, exposing a recessed tray 114 that receives components of the height adjustment assembly 300 and the locking assembly 400. In an exemplary embodiment the opening 112 has a substantially cross-shaped configuration. The inner cover 106 fits over the central opening 112 and is connected to the base 108 through one or more fasteners. The inner cover 106 is positioned over the height adjustment assembly 300 components. The outer cover 104 is connected to the main body 102 over the inner cover 106 to provide a substantially planar outer surface for the platform 100. In an exemplary embodiment, cable management clips can be connected to the rear of the main body 102.

Figure 8:
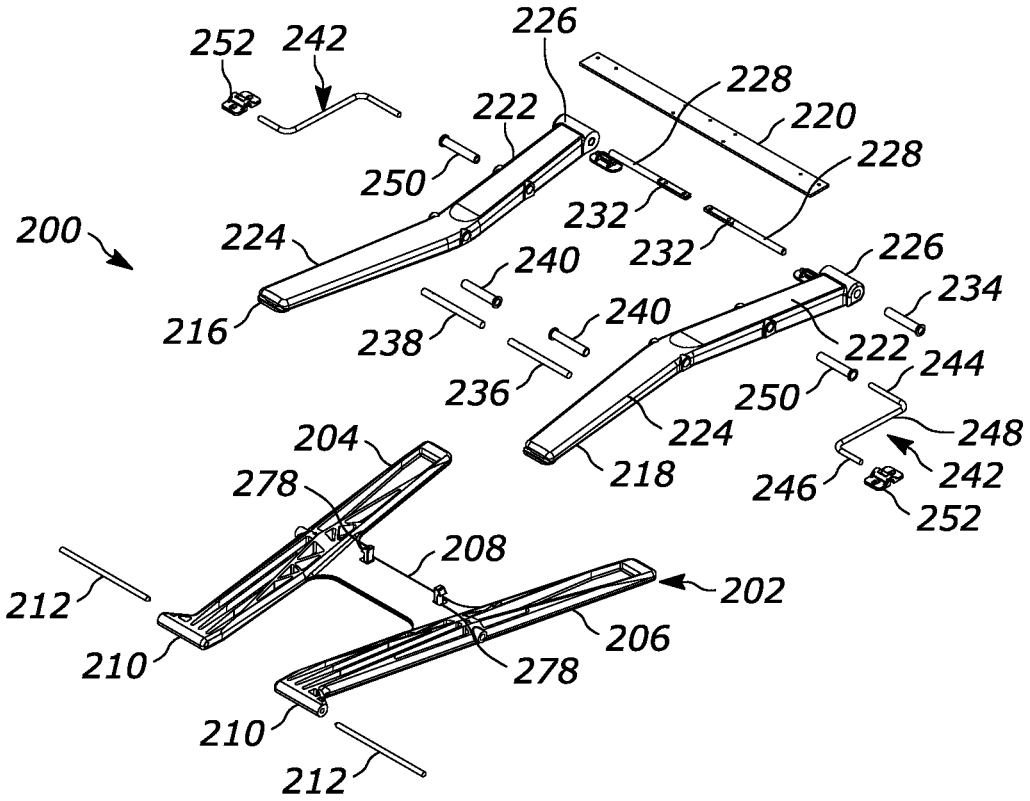
FIG. 8 is partial exploded view of the height adjustable work surface showing parts of the leg assembly.

As best shown in FIGS. 2 and 8, the leg assembly 200 can include a pair of legs connected in a scissor fashion to raise and lower the platform 100. In an exemplary embodiment, the leg assembly 200 includes an H-leg 202 rotatably and slidably connected to the front of the platform 100. The H-leg 202 includes a first leg 204, a second leg 206, and a crosspiece 208 connecting the first and second legs 204, 206. The first and second legs 204, 206 can extend at an angle to one another so that the distance between the first and second legs 204, 206 is less at the upper portion than at the lower portion. The H-leg 202 is illustrated as being formed as a monolithic piece, but can also be formed as separate pieces.

The first leg 204 and second leg 206 each includes an upper portion and a lower portion. The upper portion includes connecting members 210 to connect the legs 204, 206 to the platform 100. In an exemplary embodiment, the connecting member 210 includes a cylindrical opening that receives a pin 212. The pins 212 extend through the connecting members 210. A first end of the pin 212 extends into a first slot at least partially defined by the base 108 and a cover 214 releasably connected to the base 108. A second end of the pin is received in a second slot at least partially defined by the tray 114 and connected to the height adjustment assembly 300. The pin 212 can slide in the slots (e.g., relative rotation between the pin 212 and the slots) as the platform 100 is raised and lowered and the H-leg assembly 202 rotates about the pin 212 during movement.

The leg assembly also includes a split-leg rotatably and slidably connected to the rear of the platform. The split-leg includes a third leg 216 and a fourth leg 218 that are connected to the platform 100 and to a plate 220 that extends between the third and fourth legs 216, 218. The plate 220 is also connected to the height adjustment assembly 300. Each of the third leg 216 and the fourth leg 218 are positioned on the outside of the H-leg 202 and can include an upper portion 222 that angles toward the interior of the platform 100 and a lower portion 224 that angles toward the exterior of the platform 100.

The upper portion 222 of the third and fourth leg 216, 218 each includes a connecting member 226 to connect the respective legs 216, 218 to the platform 100. In an exemplary embodiment, the connecting member 226 includes a cylindrical opening that receives a pin 228. A first end of the pin 228 extends into a slot at least partially defined by the base 108 and a cover 230 releasably connected to the base 108. A second end of the pin 228 is connected to the plate 220. The second end of the pin 228 can have a flattened section 232 so that the pin 228 can be connected to the plate 220 with one or more fasteners. The pin 228 can slide in the slot as the platform 100 is raised and lowered and the respective third or fourth leg 216, 218 rotates about the pin 228 during movement. In some embodiments, a sleeve 234 can be positioned inside of the connecting member 226 to receive the pin 228.

In an exemplary embodiment, the H-leg 202 and the split-leg are connected to one another at an intermediate connection point along the leg assembly 200. For example, a first pin 236 can rotatably connect the first leg 204 to the third leg 216 and a second pin 238 can rotatably connect the second leg 206 to the fourth leg 218. The first and second pins 236, 238 can extend into respective openings on the legs. In some embodiments, sleeves 240 can be positioned in the openings to receive the pins 236, 238.

Figure 10:
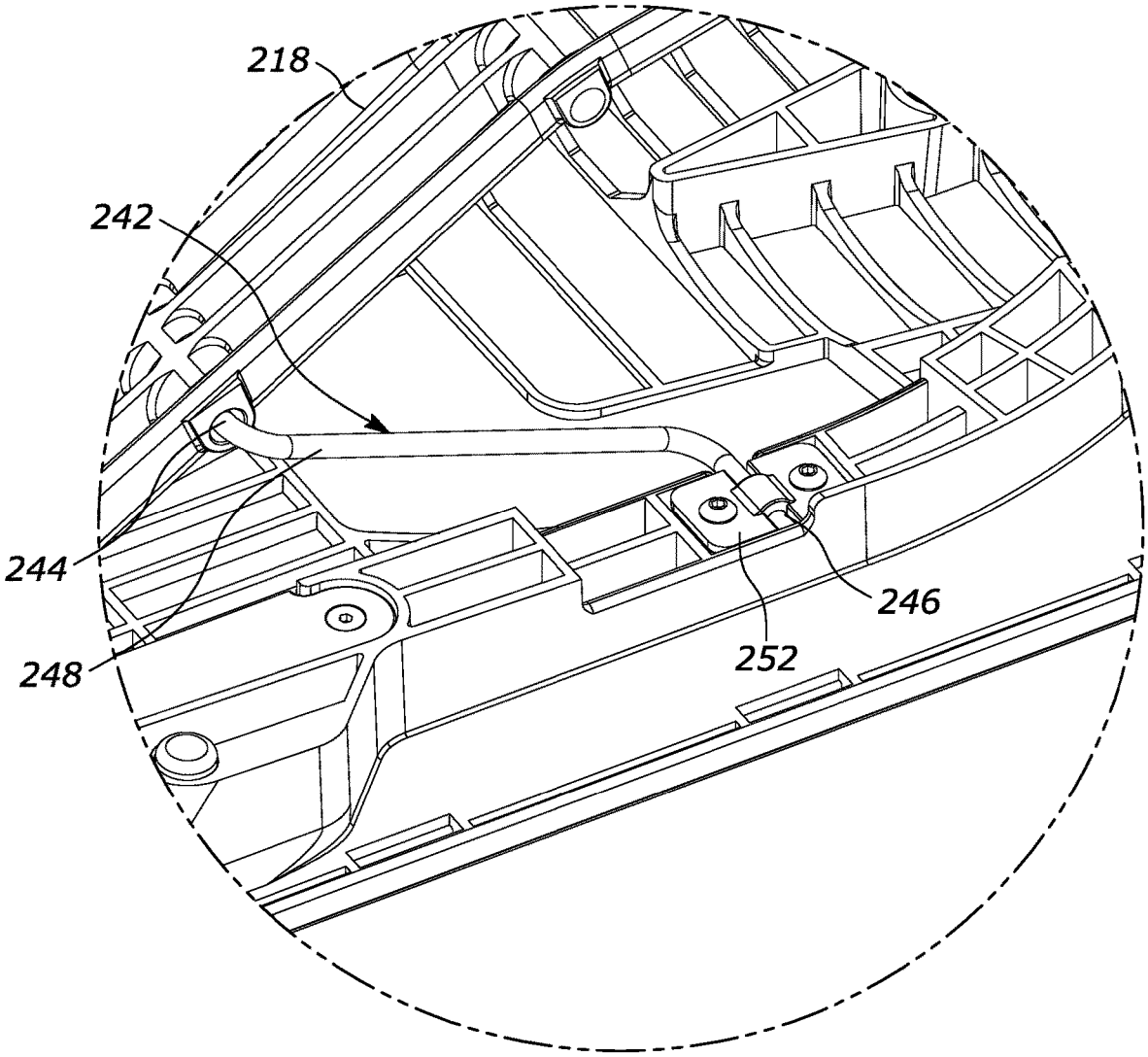
FIG. 10 is a partial view of the height adjustable work surface showing a link assembly.

As shown in FIGS. 2, 8, and 10, one or more links 242 can be connected to the platform 100 and to the leg assembly 200. For example a first link 242 can be connected to the third leg 216 and a second link 242 can be connected to the fourth leg 218. The links 242 are connected between the upper connection and the intermediate connection. The links 242 have a substantially S-shaped configuration with a first end 244 extending into the respective third or fourth leg 216, 218, a second end 246 connected to the main body 102, and middle section 248 connecting the first and second ends 244, 246. Other link configurations can be used, including a pin having a main body connected to separate pivot pins.

The first end 244 of the link 242 can be received by a sleeve 250 positioned in the respective third or fourth leg 216, 218. The second end 246 of the link 242 can be connected to the base by a link bracket 252 that is fixedly attached to the main body 102. The second end 246 of the link 242 can be positioned so that it aligns with the pivot point of the leg structure and a midpoint of the platform along the line C1.

In certain embodiments, the position of the link bracket 252 is adjustable relative to the main body 102, for example along an axis running from the front to the back of the platform 100. This creates a floating connection point that can allow for easier assembly of the link 242. For example, the exact position of the second end 246 of the link 242 will depend on the position of the leg assembly 200, height adjustment assembly 300, and locking assembly 400. This position may not always be in an exact location due to manufacturing and assembly tolerances. Allowing adjustment of the link bracket position (i.e., plus or minus 2 mm from a set point) accommodates these tolerances.

Figure 11:
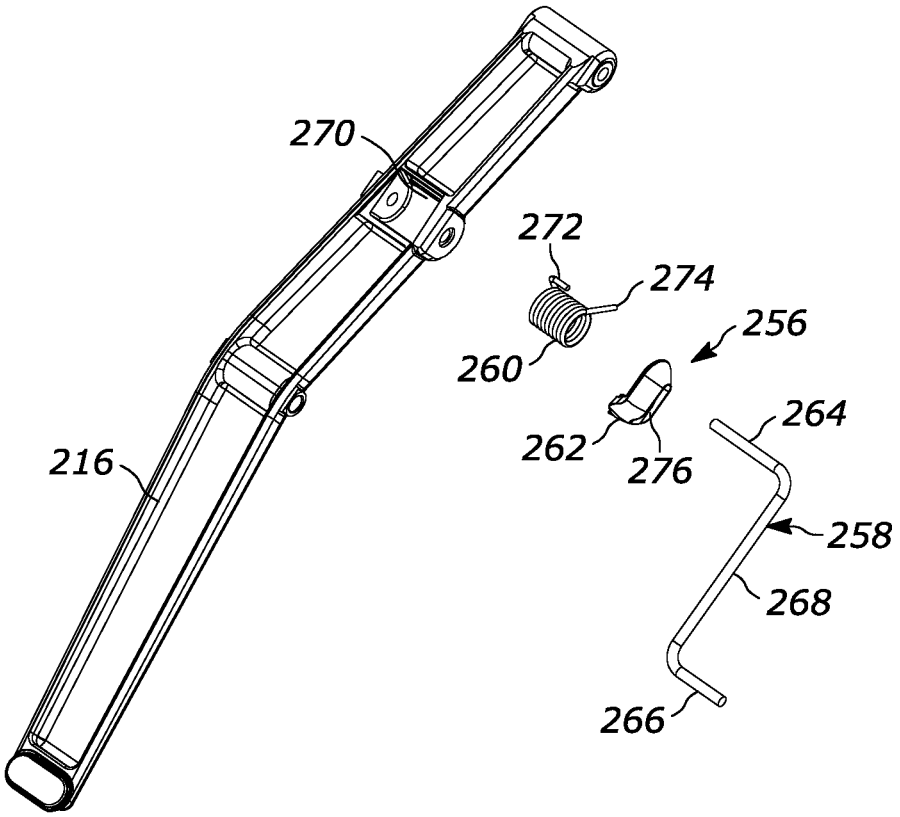
FIG. 11 is a perspective, exploded view of a leg, torsion spring, and link assembly.
Figure 12:
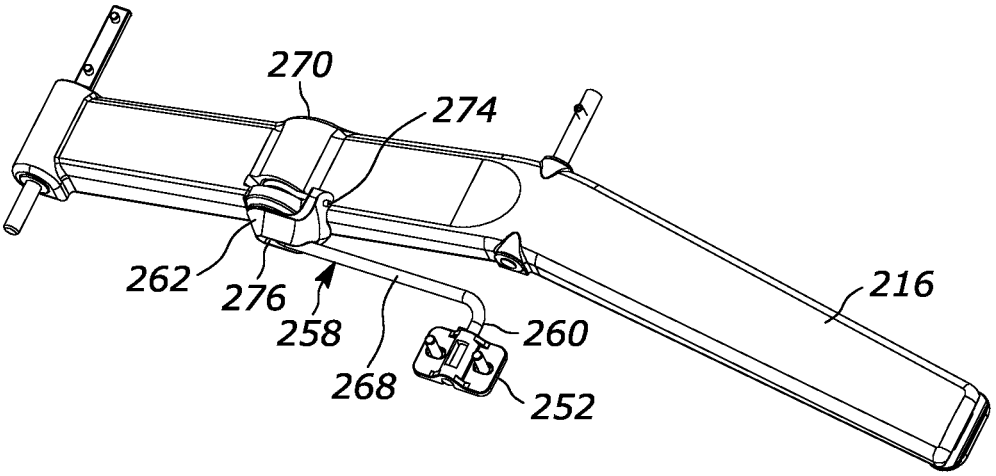
FIG. 12 is a perspective view of the leg, torsion spring, and link assembly of FIG. 11.

FIGS. 11 and 12 show another exemplary embodiment that includes a torsion spring link assembly 256. The torsion spring link assembly 256 includes a link 258, a torsion spring 260, and a spring bracket 262. The torsion spring links 258 have a substantially S-shaped configuration with a first end 264 extending into the respective third or fourth leg 216, 218, a second end 266 connected to the main body 102, and middle section 268 connecting the first and second ends 264, 266. A spring housing 270 is formed in the third and fourth leg 216, 218. For example a depression is formed in the leg and is sized and shaped to receive the appropriate sized spring. The torsion spring 260 is positioned in the spring housing 270. The torsion spring 260 has a first end 272 that is biased against the spring housing 270 and a second end 274 that is connected to an opening in the spring bracket 262. The spring bracket 262 is rotatably connected to the exterior of the respective leg and includes a slot 276 that receives the middle section 268 of the link 258 so that the link 258 is rotatably fixed to the spring bracket 262. The second end 266 of the link 258 can be connected to the main body 102 by a link bracket 252 that is attached to the base 108. During use, the torsion spring 260 applies a force to the link 258 that biases the link 258, and thus the leg assembly 200 to the raised position. In certain embodiments the torsion spring 260 can be replaced with a different biasing member.

As shown in FIGS. 7, 9, and 13-15, the height adjustment assembly 300 includes an H-leg slider 302, an H-leg biasing mechanism 304, a split-leg slider 306, and a split-leg biasing mechanism 308. The H-leg slider 302 and split-leg slider 306 are positioned in the tray 114 and are configured to slide relative to one another as the platform 100 and leg assembly 200 are moved from the raised to the lowered position. The biasing mechanisms 304, 308 biasing the sliders 302, 306 to the raised position, allowing a user to more easily raise the platform 100 and any load supported thereon.

The H-leg slider 302 includes a body 310 having proximate end positioned toward the front of the platform 100 and a distal end positioned toward the rear of the platform 100. The proximate portion includes a connecting member 312 configured to receive the pins 212 from the H-leg assembly. The proximate portion also includes an attachment feature 314 that connects the H-leg biasing mechanism 304 to the body 310. The attachment feature 314 can include a hook, slot, channel or other feature configured to connect to an end of the H-leg biasing mechanism 304.

Figure 9:
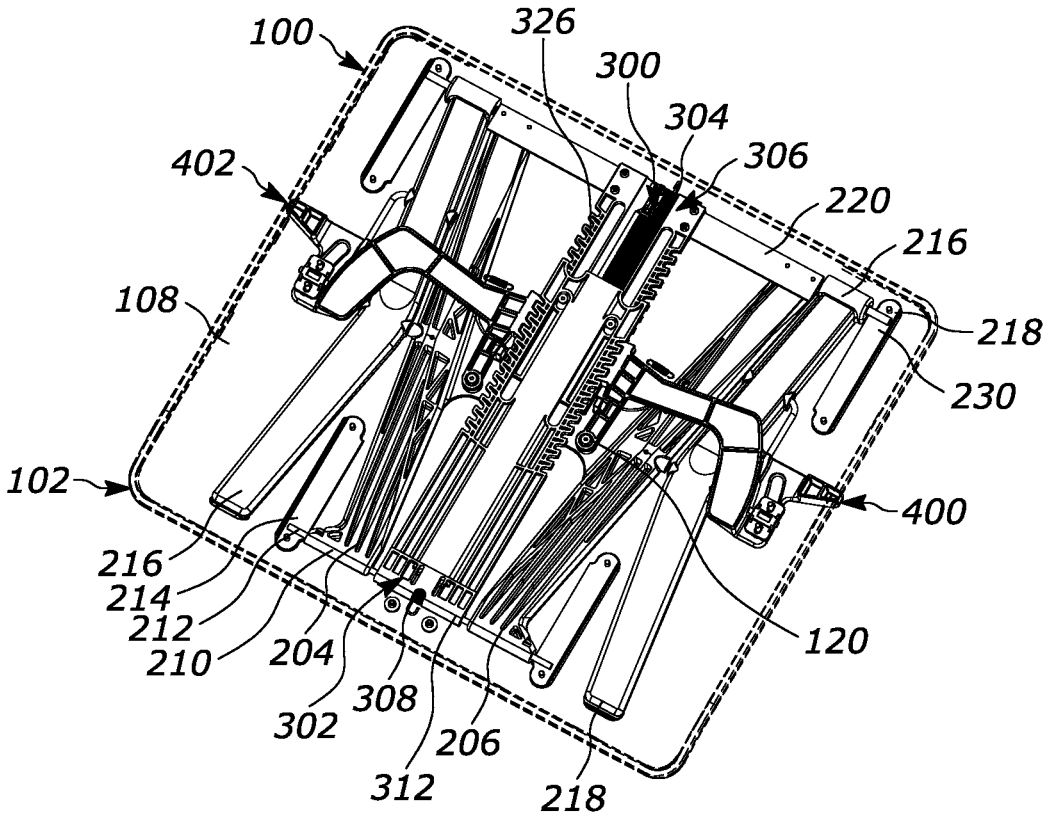
Figure 9A:
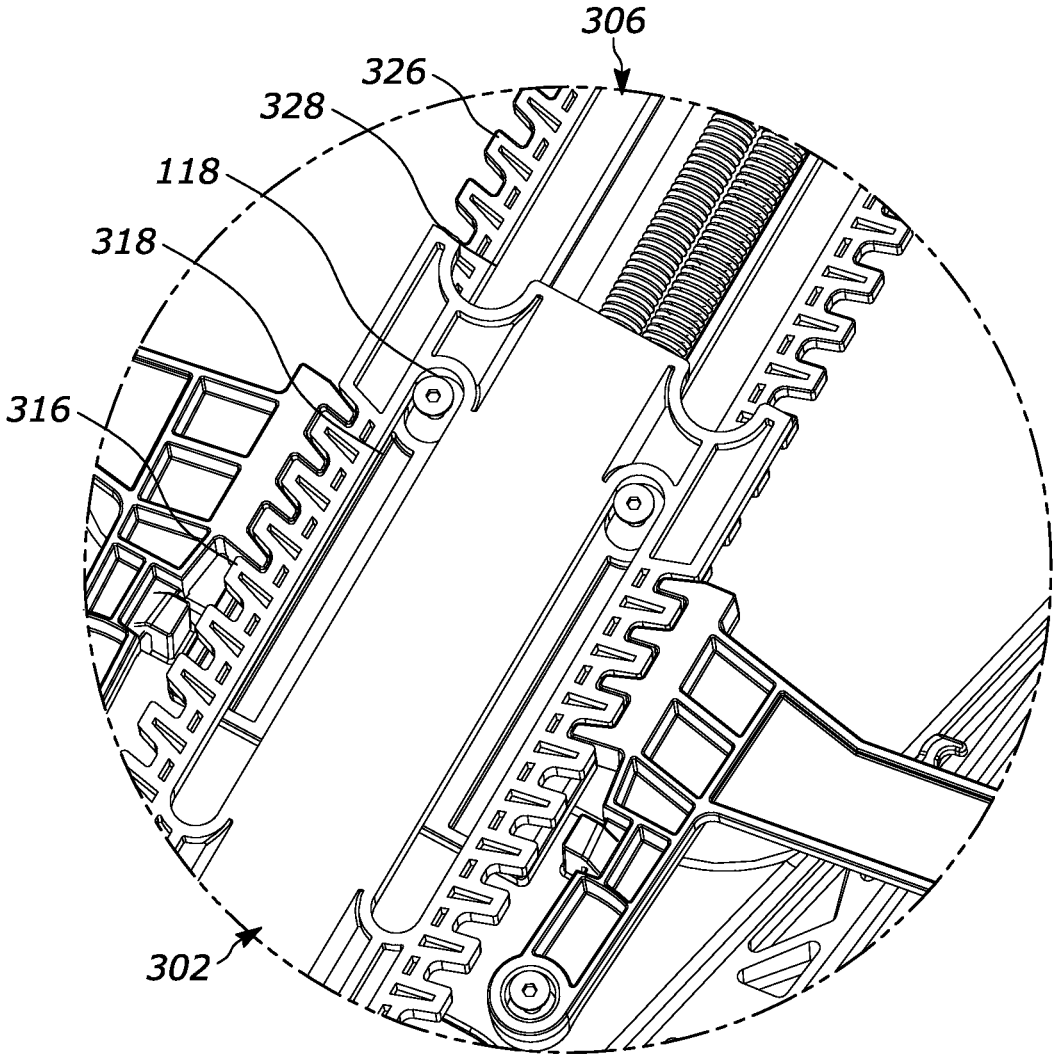
FIG. 9A is partial, enlarged view of FIG. 9.

A plurality of teeth 316 are positioned along each side of the body 310 and are configured to engage the locking assembly 400. The teeth 316 are angled toward the distal end of the body 310. Movement of the H-leg slider 302 is guided by one or more slots 318 formed in the body 310. The slots 318 receive a protrusion extending from the tray 114, for example a cylindrical post or protrusion 118 as best shown in FIG. 9A. The protrusion 118 extends into the slot 318 to confine the H-leg slider 302 to linear movement with respect to the tray 114. Notches 320 are formed in the distal end of the H-leg slider 302 and assist a user in connecting the H-leg biasing mechanism 304 during assembly.

The H-leg biasing mechanism 304 includes a first end connected to the H-leg slider 302 and a second end connected to the main body 102. A force is exerted by the H-leg biasing mechanism 304 to bias the H-leg slider 302 to the rear of the platform (i.e., the raised position). The first and second ends of the H-leg biasing mechanism 304 can include connecting features such as hooks or loops that allow the ends to be releasably connected. In an exemplary embodiment the H-leg biasing mechanism 304 includes a single coil extension spring having a hook formed in the first and second ends. Other types of biasing mechanisms, including gas springs, elastomeric springs, etc, can also be used.

The split-leg slider 306 includes a body 322 having a proximate end positioned toward the front of the platform 100 and a distal end positioned toward the rear of the platform 100. The distal portion of the body 322 is connected to the plate 220. The distal portion also includes a connection 324 for the split-leg biasing mechanism 308. The connection 324 can include a hook, slot, channel or other feature configured to connect to an end of the split-leg biasing mechanism 308. The body 322 also includes a plurality of teeth 326 along each side of the body 322 that are configured to engage the locking assembly 400. The teeth 326 are angled toward the distal end of the body 322. The teeth 326 of the split-leg body 322 are also configured to align with the teeth 316 of the H-leg body 310. Movement of the split-leg slider 306 is guided by one or more slots 328 formed in the body. The slots 328 receive a protrusion 118, for example a cylindrical post, extending from the tray 114. The protrusion 118 extends into the slot 328 to promote translation of the split-leg slider 306 with respect to the tray 114. In an exemplary embodiment, the protrusions 118 extend through the slots 318, 328 in both the H-leg slider 302 and the split-leg slider 306.

The split-leg biasing mechanism 308 includes a first end connected to the main body 102 and a second end connected to the split-leg slider 306. A force is exerted by the split-leg biasing mechanism 308 to bias the split-leg slider 306 to the front of the platform 100 (i.e., the raised position). The first and second ends of the split-leg biasing mechanism 308 can include a connecting feature such as hooks or loops that allow the ends to be releasably connected. In an exemplary embodiment the split-leg biasing mechanism 308 includes a single coil extension spring having a hook formed in the first and second ends. Other types of biasing mechanisms can also be used.

Figure 13:
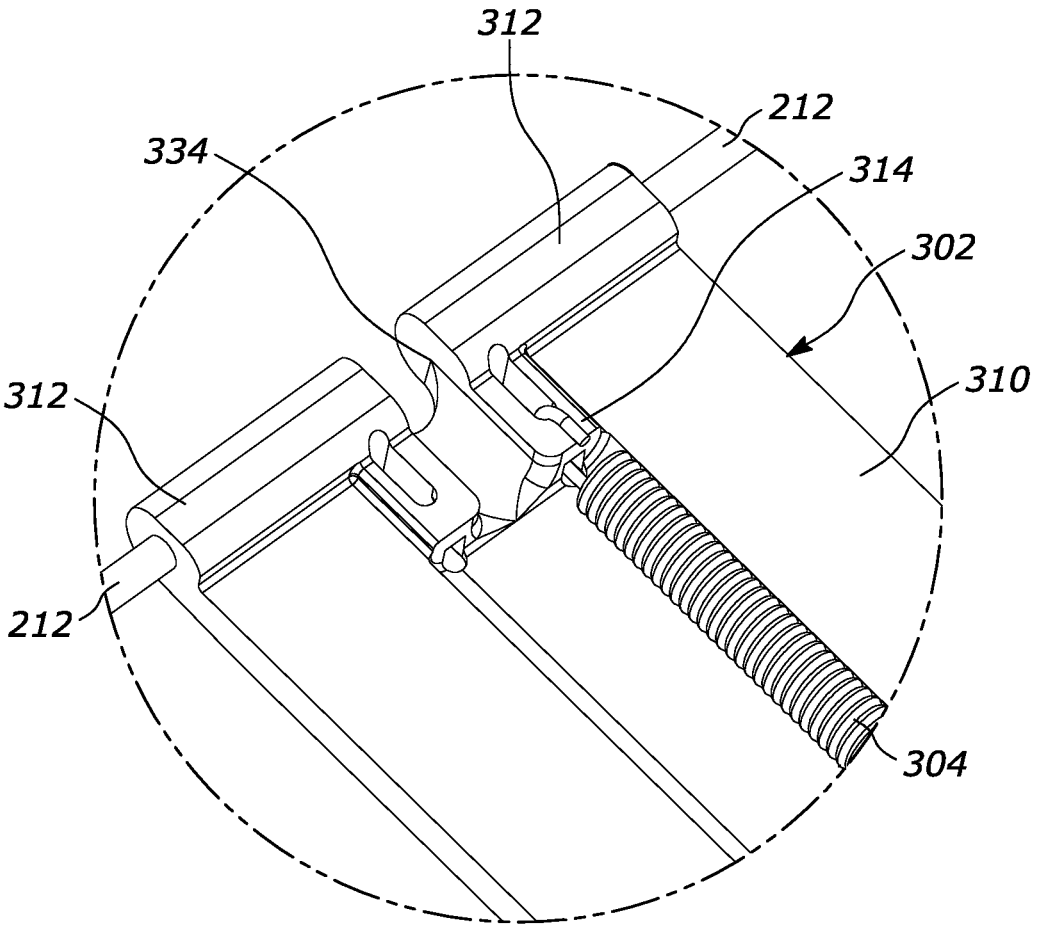
FIG. 13 is a partial view of the h-leg slider and biasing mechanism.
Figure 14:
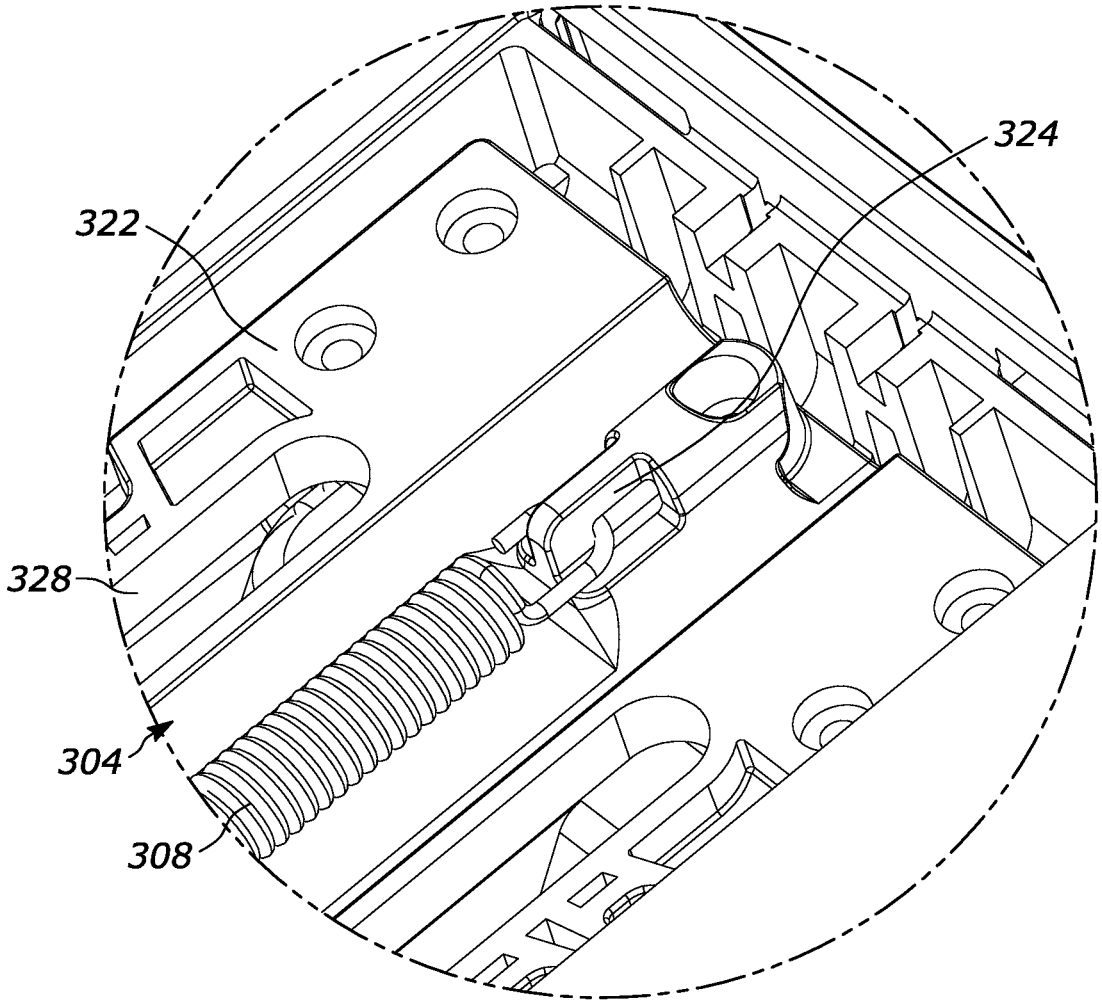
FIG. 14 is a partial view of the split-leg slider and biasing mechanism.
Figure 15:
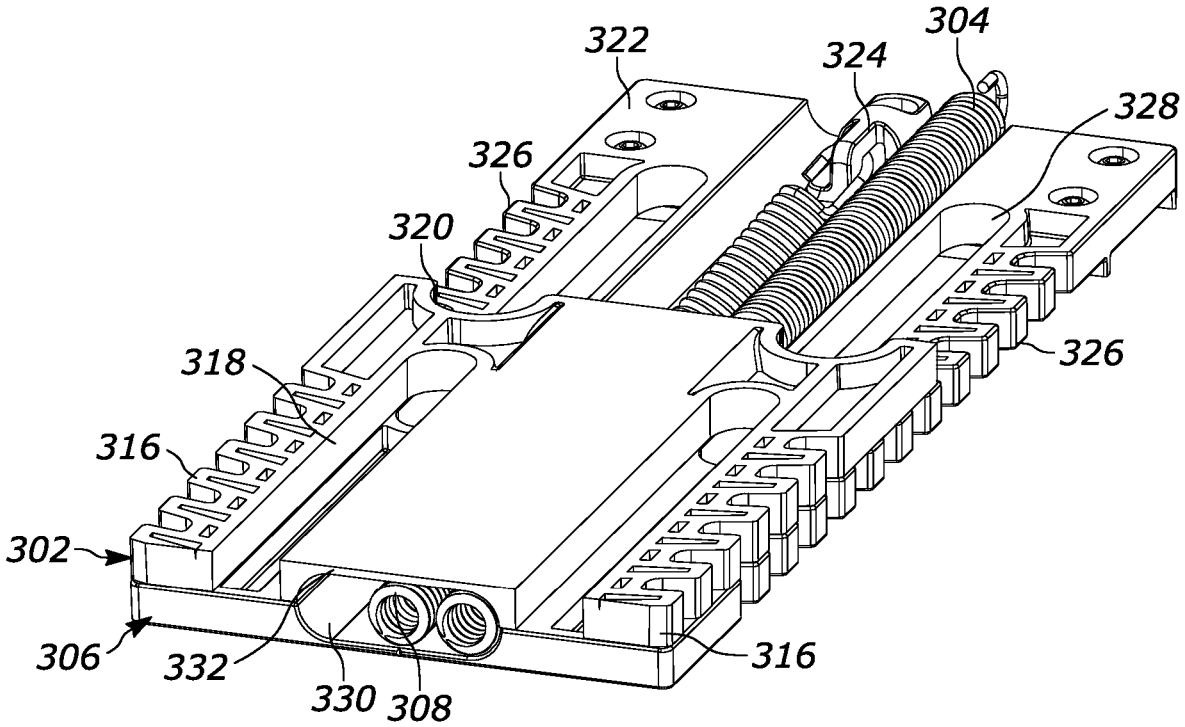
FIG. 15 is a partial view of the h-leg slider, split-leg slider and biasing mechanisms.
Figure 16:
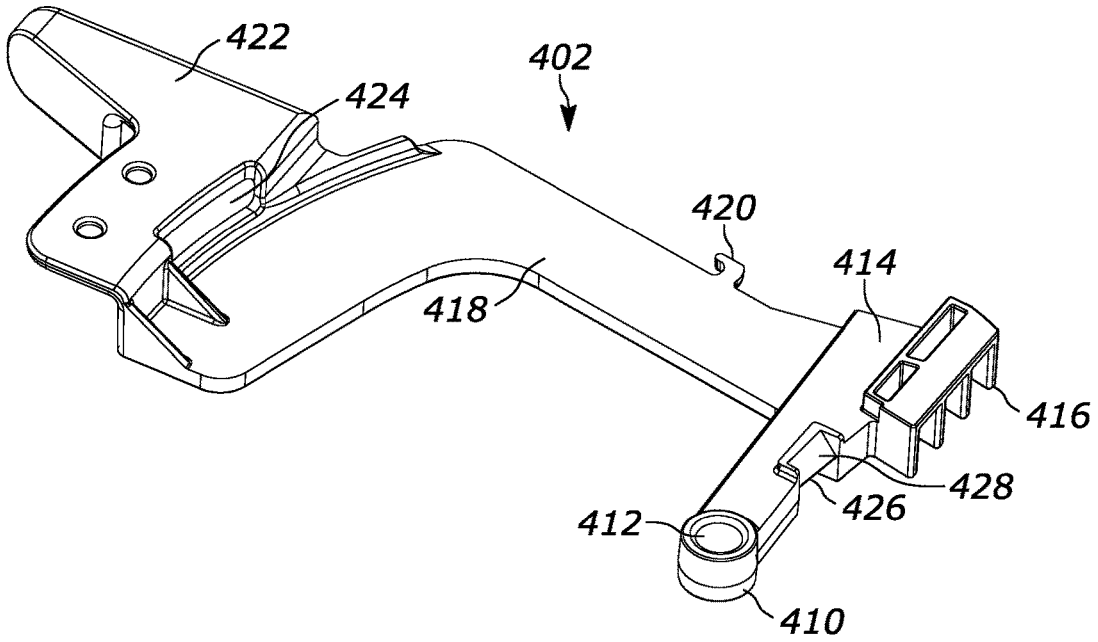
FIG. 16 is a top perspective view of an arm of the locking assembly.
Figure 17:
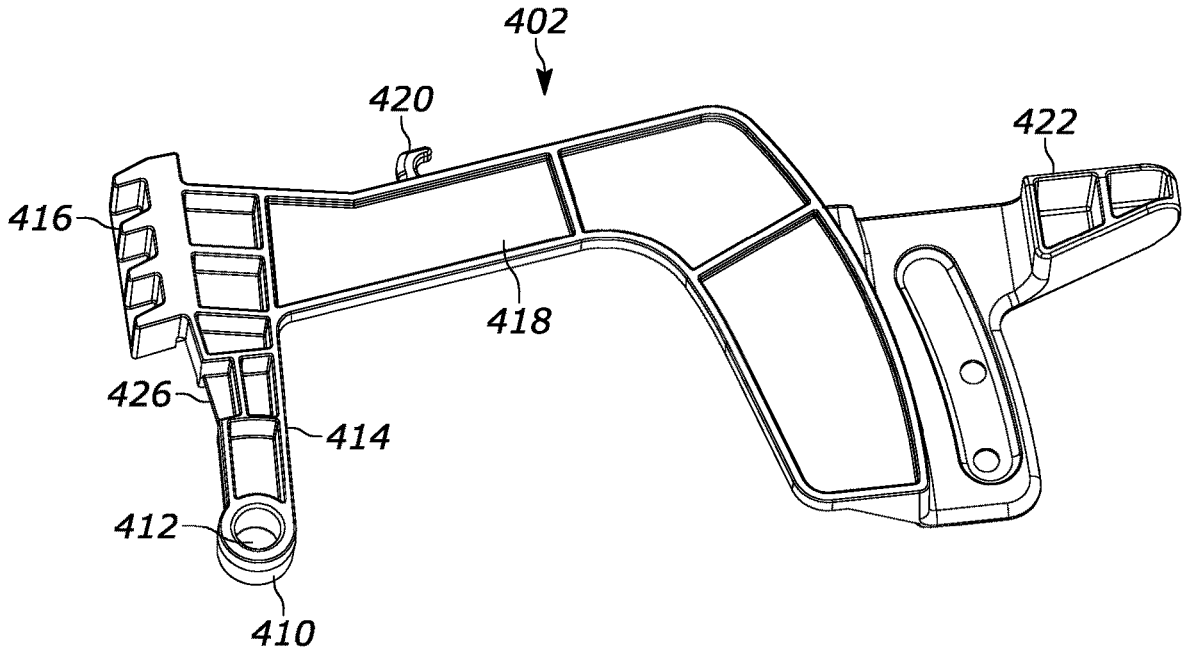
FIG. 17 is a bottom perspective view of the arm of FIG. 16.
Figure 18:
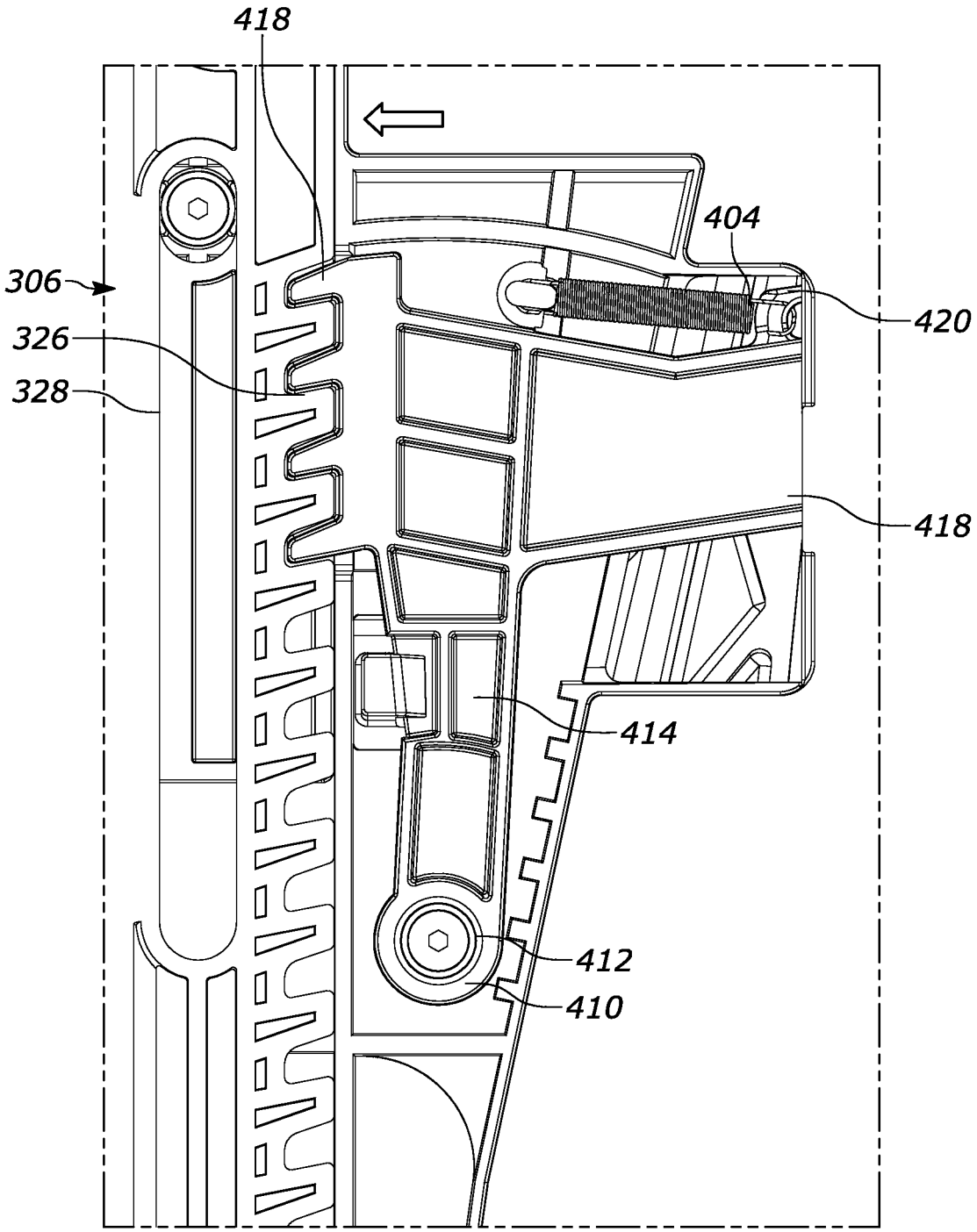
FIG. 18 is a partial view showing the arm engaging the sliders.
Figure 19:
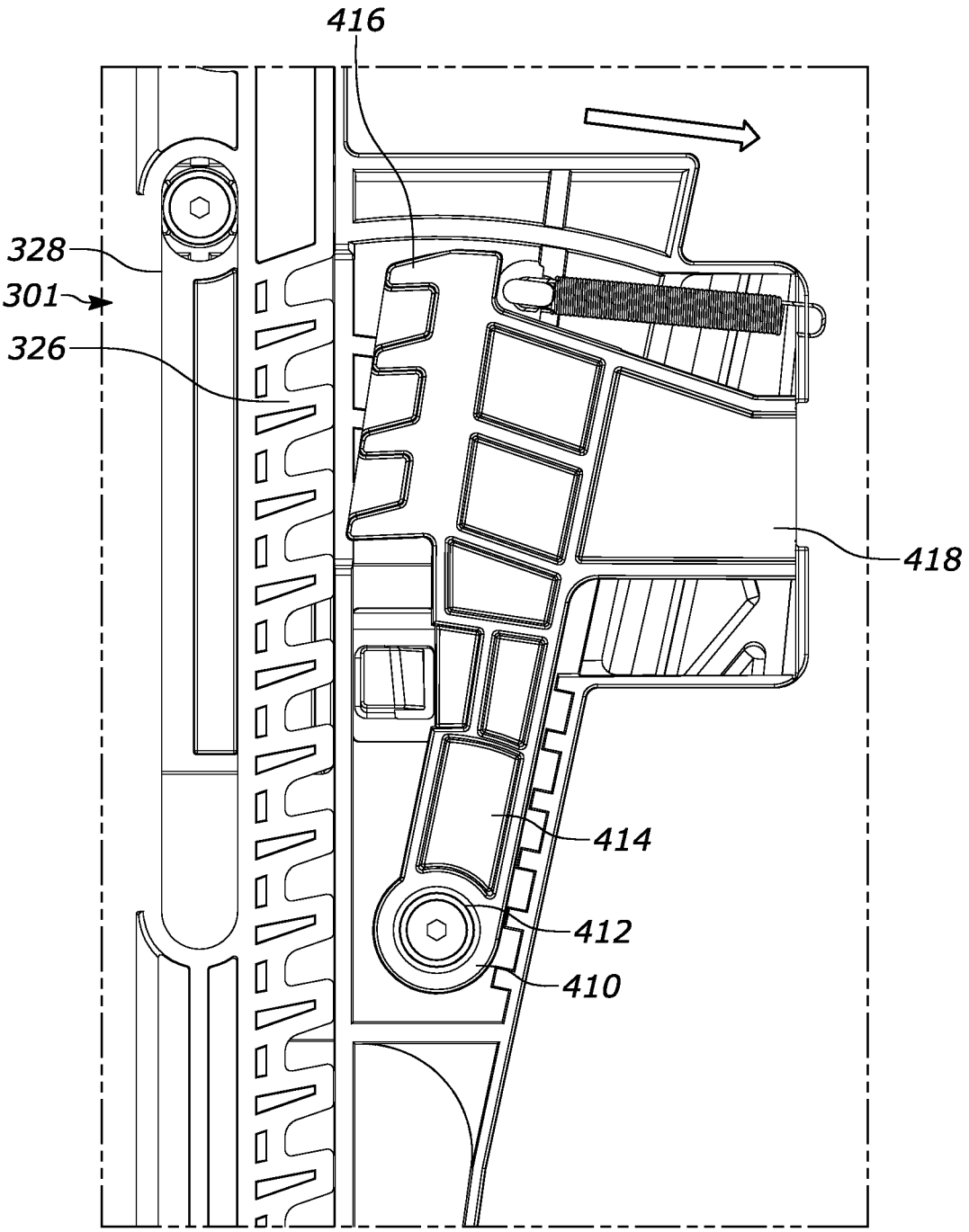
FIG. 19 is a partial view showing the arm disengaging the sliders.
Figure 20:
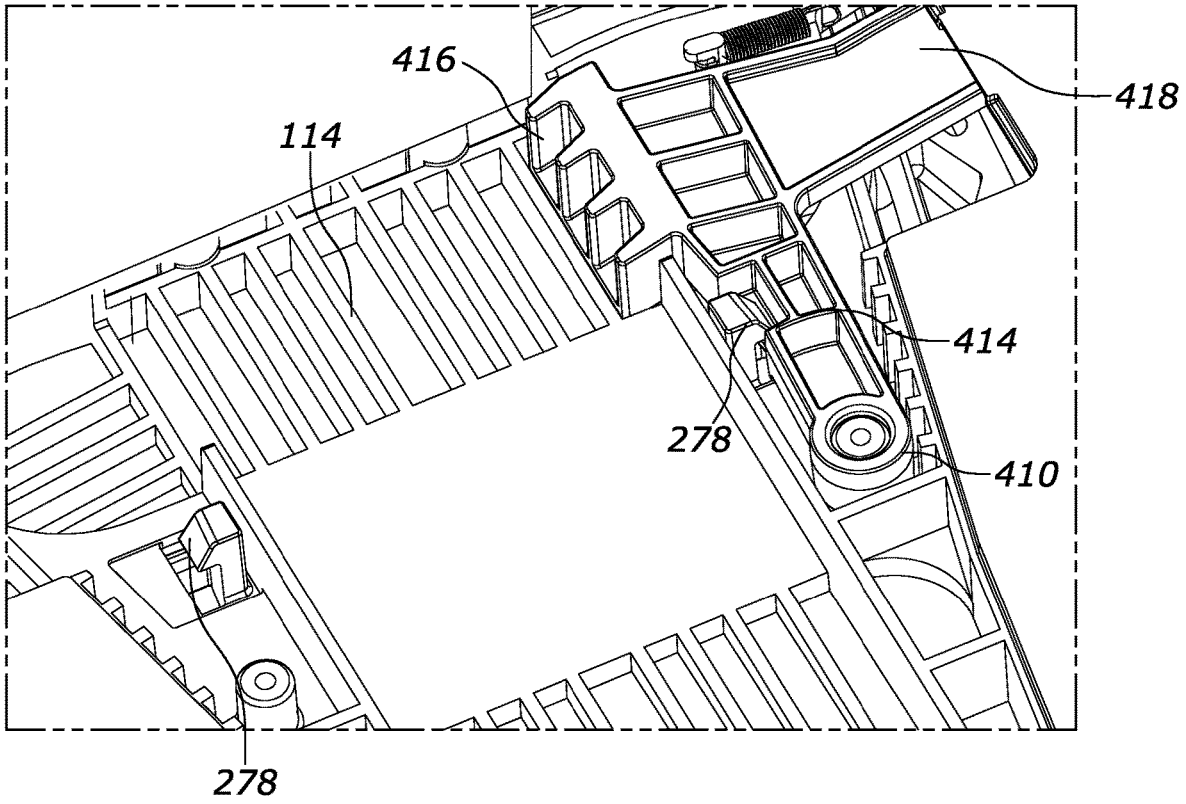
FIG. 20 is a partial view showing the lower position lock engaged.

In an exemplary embodiment, the body of the H-leg slider 302 and the split-leg slider 306 can each include a recessed groove 330, 332 that receives a portion of the length of the H-leg biasing mechanism 304 and the split-leg biasing mechanism 308 as shown in FIG. 15. The longitudinal axes of the biasing mechanisms can extend parallel to one another and in the same horizontal plane, although offset orientations can also be used. As shown in FIG. 13, the H-leg slider 302 includes an opening 334 that allows the split-leg biasing mechanism 308 to extend through the H-leg slider 302 and connect to the main body 102.

According to various exemplary embodiments, the locking assembly 400 includes a first arm 402, a first arm biasing mechanism 404, a second arm 406, and a second arm biasing mechanism 408. The first and second arms 402, 406 are moveably connected to opposite sides of the main body 102 between a locked position that prevents movement of the leg assembly 200 and a released position that allows movement of the leg assembly 200. The first and second arms 402, 406 can extend from underneath the platform 100 and be accessible to a user to engage and disengage the locking assembly 400. In an exemplary embodiment, the locking assembly 400 directly engages with the slider assembly 300 to prevent movement, although other configurations (e.g., direct engagement with the leg assembly) can also be used. The first and second arm biasing mechanisms 404, 408 bias the arms 402, 406 into the locked position.

In the illustrated embodiment, the first and second arms 402, 406 are mirror images of each other and share the same structural features. As such, only a single arm is described in detail. Other exemplary embodiments can include arms with different structures. Some embodiments can utilize a single moveable arm for the locking assembly. The first and second arms are also shown as unitarily formed or monolithic members, although they can also be formed in separate parts.

As best shown in FIGS. 16-19, the first arm 402 includes a connection member 410 that allows the arm to moveably connect to the platform 100. The connection member 410 can include an opening 412 configured to receive a protrusion 120 extending from the main body 102. The arm 402 rotates about an axis extending through the opening 412. The opening 412 can be a cylindrical opening defined by a cylindrical wall. The cylindrical opening rotatably engages the protrusion 120 and allows the arm to rotate between a first position and a second position. Other types of rotatable connections and elements can be used. Other types of moveable connections can also be used, including sliding connections.

A first body portion 414 of the arm extends away from the cylindrical wall. A set of arm teeth 416 are formed in the first body portion 414. The arm teeth 416 angle toward the proximate portion of the platform 100 and are configured to releasably mate with the teeth 316, 326 of the slider assembly 300. The size of the arm teeth 416 allows them to mate with both the H-leg slider teeth 316 and the split-leg slider teeth 36. In certain embodiments, the set of teeth 416 includes either three or four teeth. If too few teeth are used, the engagement strength is insufficient and if too many teeth are used the locking assembly 400 can become too bulky.

When the sets of teeth are engaged, the riser is locked in position and when the sets of teeth are disengaged the riser can be raised or lowered. In this way the platform 100 can be retained at different heights with the arm teeth 416 capable of engaging any set of the slider teeth 316, 326. The angle of the arm teeth 416 creates a self locking behavior when the platform 100 is under load.

A second body portion 418 of the arm 402 extends away from the first body portion 414 outwardly toward the outer edge of the platform 100. A hook 420 can extend from the second body portion 418 to receive the first arm biasing mechanism 404. A handle 422 extends from the second body portion 418. The handle 422 extends underneath the platform 100 and is configured for user engagement. For example, by pulling the handle 422, the user can rotate the first arm 402 to disengage the arm teeth 416 from the slider assembly 300. Additionally, a slot 424 is formed in the arm 402 that receives the link 242/256, allowing the arm 402 to move relative to the link 242/256.

The first arm biasing mechanism 404 includes a first end connected to the main body 102 and a second end connected to the first arm 402. A force is exerted by the first arm biasing mechanism 404 to bias the first arm 402 into engagement with the slider assembly 300 (i.e., a locked position). The first and second ends of the first arm biasing mechanism 404 can include a connecting feature such as hooks or loops that allow the ends to be releasably connected. In an exemplary embodiment the first arm biasing mechanism 404 includes a single coil extension spring having a hook formed in the first and second ends. Other types of biasing mechanisms can also be used.

Use of the two arms as shown and described requires that both arms must be intentionally moved by the user to release the height adjustment assembly 300 for movement in either direction. This helps prevent inadvertent movement of the platform 100. In an exemplary embodiment, the arms 402, 404 are positioned to be at least partially along mid-line C1 of the riser. This allows the user to more easily raise or lower the platform compared with handles that are positioned closer to the user.

FIGS. 20-23 show an exemplary embodiment of a lower position lock assembly that can be incorporated into the riser. The lower position lock releasably secures the riser in the lowered position, for example with the leg assembly 200 positioned inside of the platform 100. By locking the movement of the leg assembly 200 with respect to the platform 100 when in the lowered position, the riser can be more easily carried from one location to another without risk of unwanted expansion of the legs beyond the platform. In some embodiments the ease of movement and storage provides greater flexibility for the desktop riser than can be achieved with work surfaces designed to be positioned in a single place.

The lower position lock assembly includes a set of protrusion 278 extending from the first and second legs 204, 206 of the H-leg 202. The protrusions 278 can include a cantilevered hook member having a head with an angled top edge. A recessed tab 426 is formed on the first and second arms 402, 406. The recessed tab 426 includes an angled bottom wall 428. When in the locked position, the hook engages the tab 426, which prevents or limits the leg assembly 200 from moving relative to the locking assembly 400, and therefore the platform 100.

Figure 21:
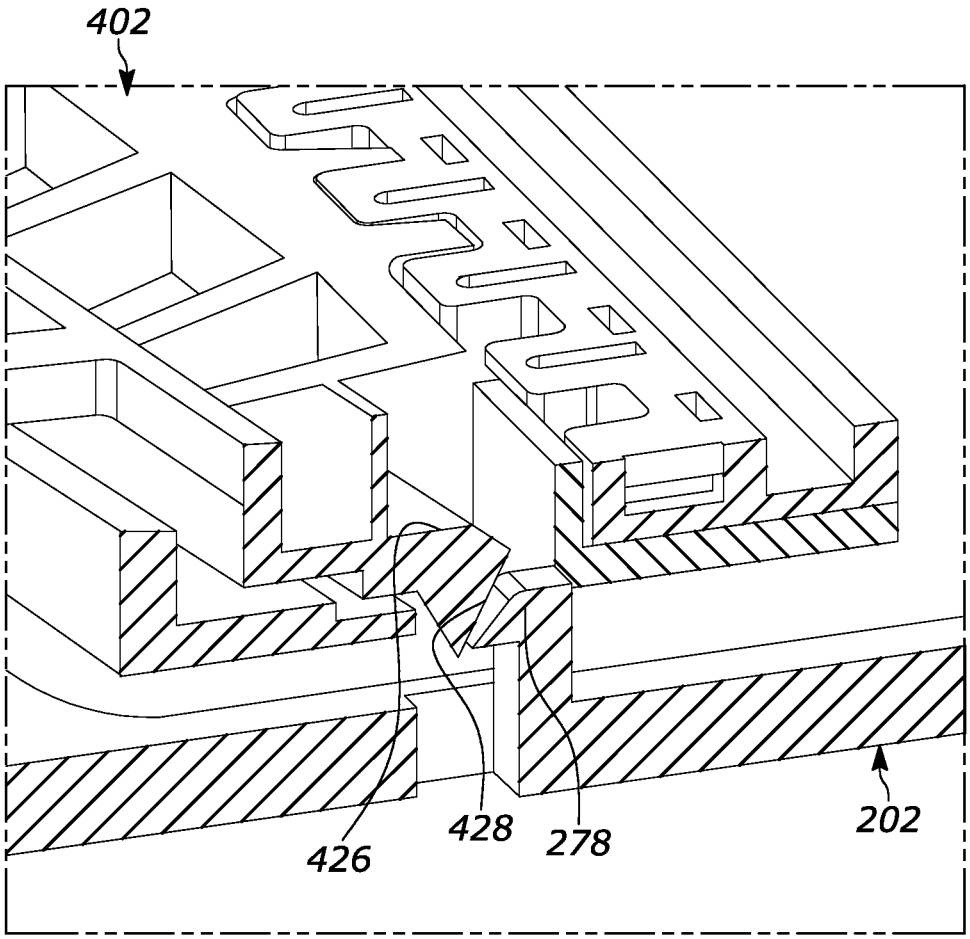
FIG. 21 is a partial, sectional view showing the lower position lock beginning to engage.
Figure 22:
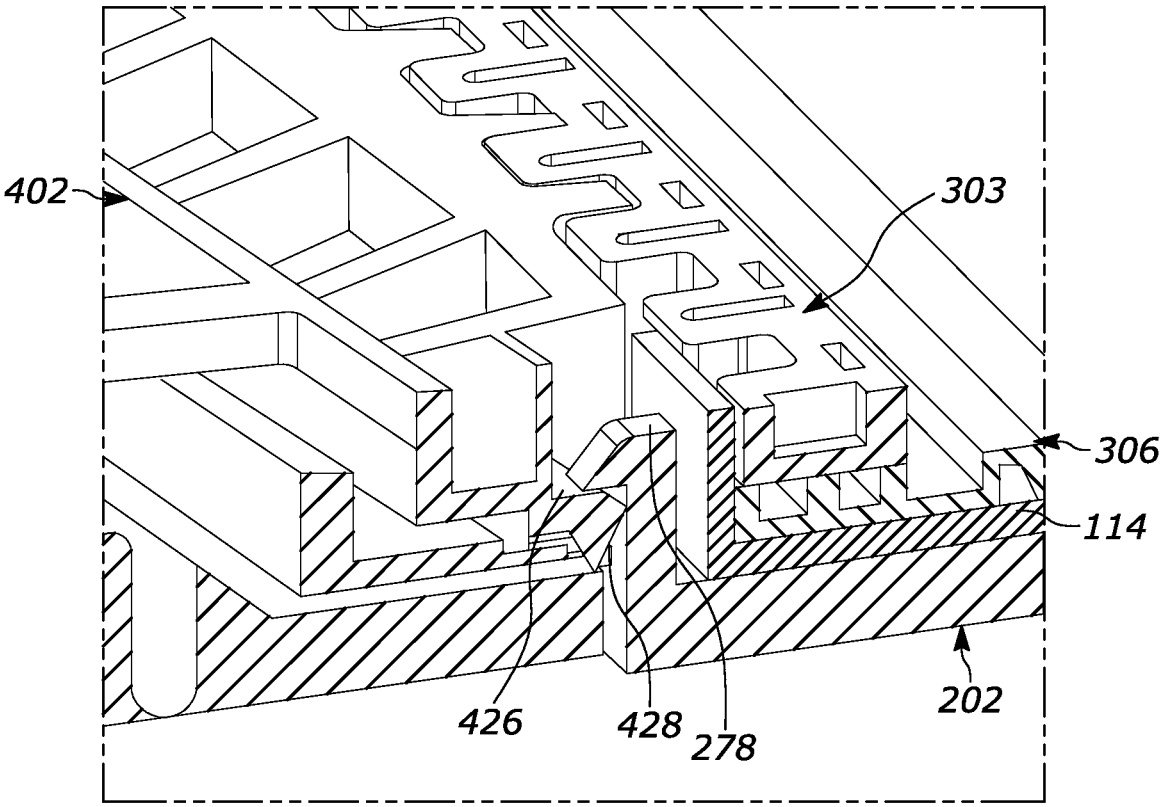
FIG. 22 is a partial, sectional view showing the lower position lock engaged.
Figure 23:
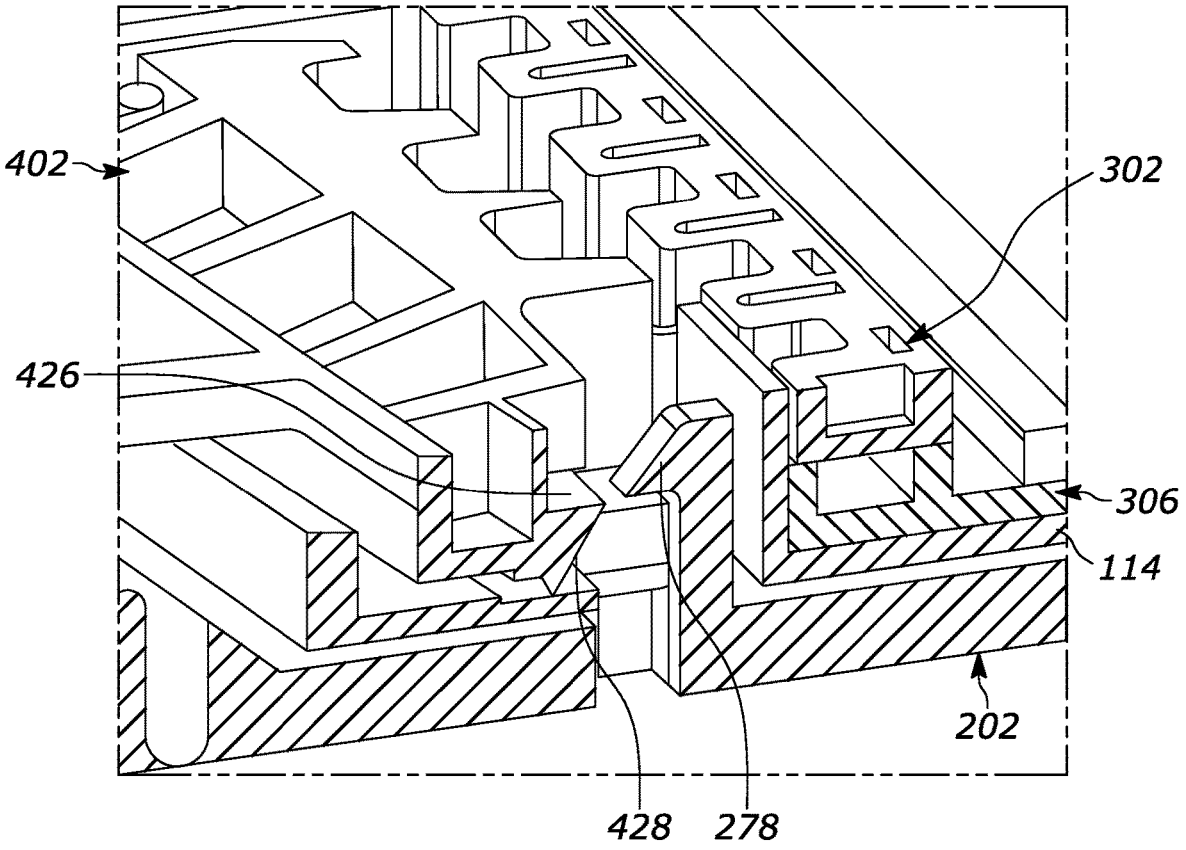
FIG. 23 is a partial, sectional view showing the lower position lock being disengaged.

When lowering the riser from the raised position, the head of the protrusion 278 can engage the angled bottom wall 428 in the respective arm 402, as shown in FIG. 21. Engagement of the protrusion 278 with the arm 402 can push the arm 402 to the exterior of the platform 100 to provide space for the protrusion 278 to extend between the tab 426 and the main body 102. Once the protrusion 278 has cleared the tab 426, the arm 402 will move back toward the interior of the platform 100 under the force of the biasing member, allowing the hook to engage the tab 426 to prevent movement of the leg assembly 200 as shown in FIG. 22. To disengage the lock assembly, a user must move the arms 402, 406 outwardly as shown in FIG. 23 so that the tab 426 clears the hook member of the protrusion 278, allowing the leg assembly 200 to move relative to the platform 100.

Figure 24:
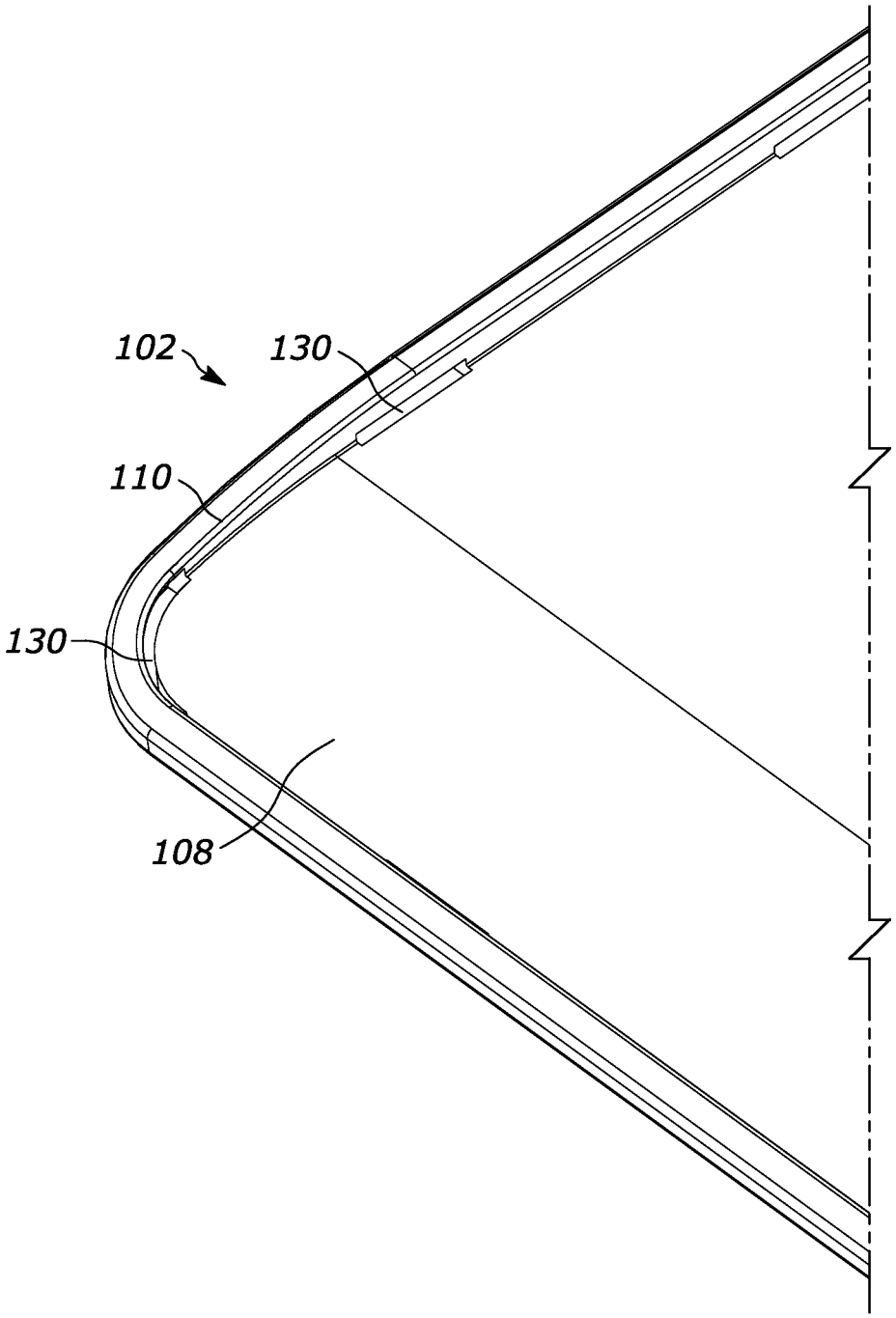
FIG. 24 is a partial view showing the platform main body.
Figure 25:
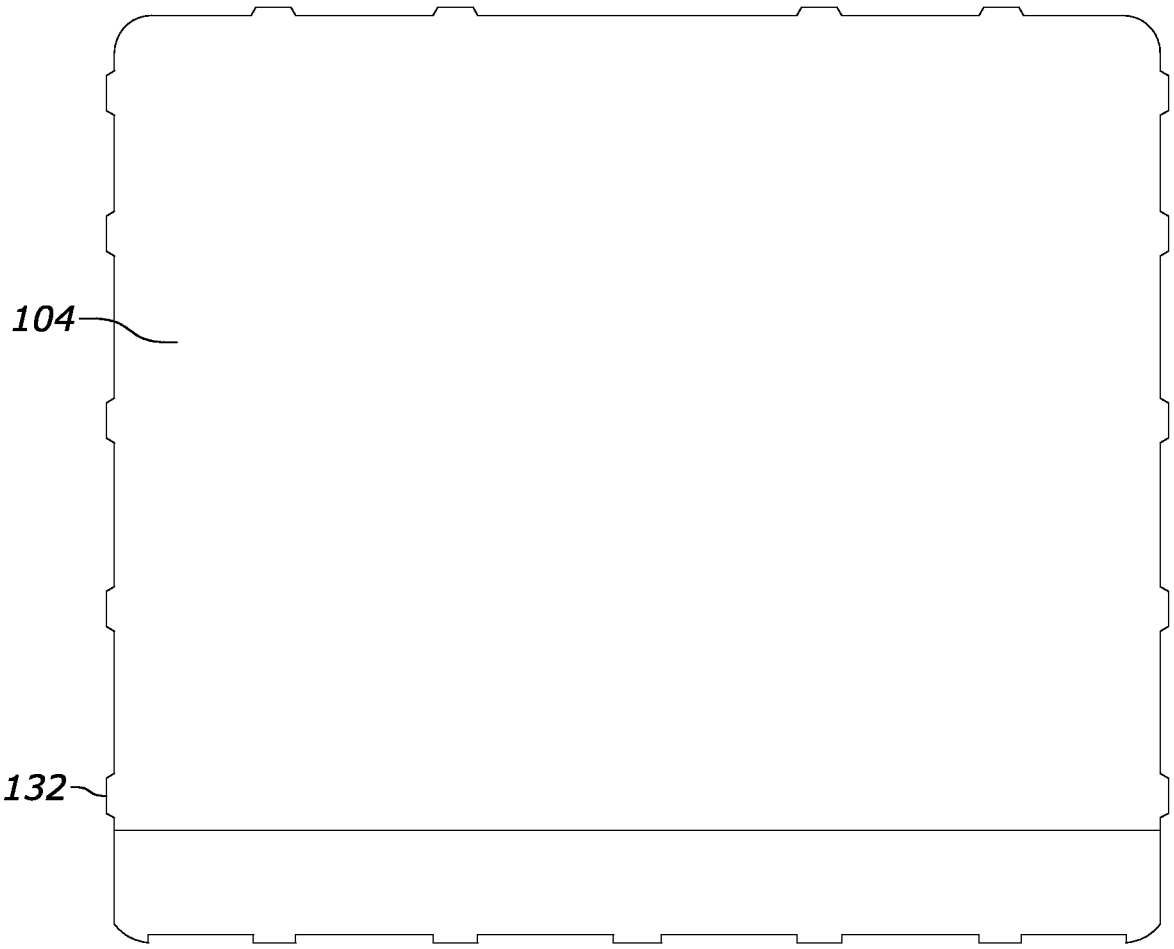
FIG. 25 is top view of the outer cover.

FIGS. 24 and 25 show an exemplary embodiment of the connection between the main body 102 of the platform 100 and the outer cover 104. The main body 102 includes a set of openings 130 positioned, for example, at the intersection of the base 108 and the rim 110. The openings 130 are configured to receive tongues 132 that extend from the outer cover 104. The tongues 132 can be used along with an adhesive to provide a more secure connection between the outer cover 104 and the base 108. Different styles of outer covers 104 can also be used with the platform 100.

Figure 26:
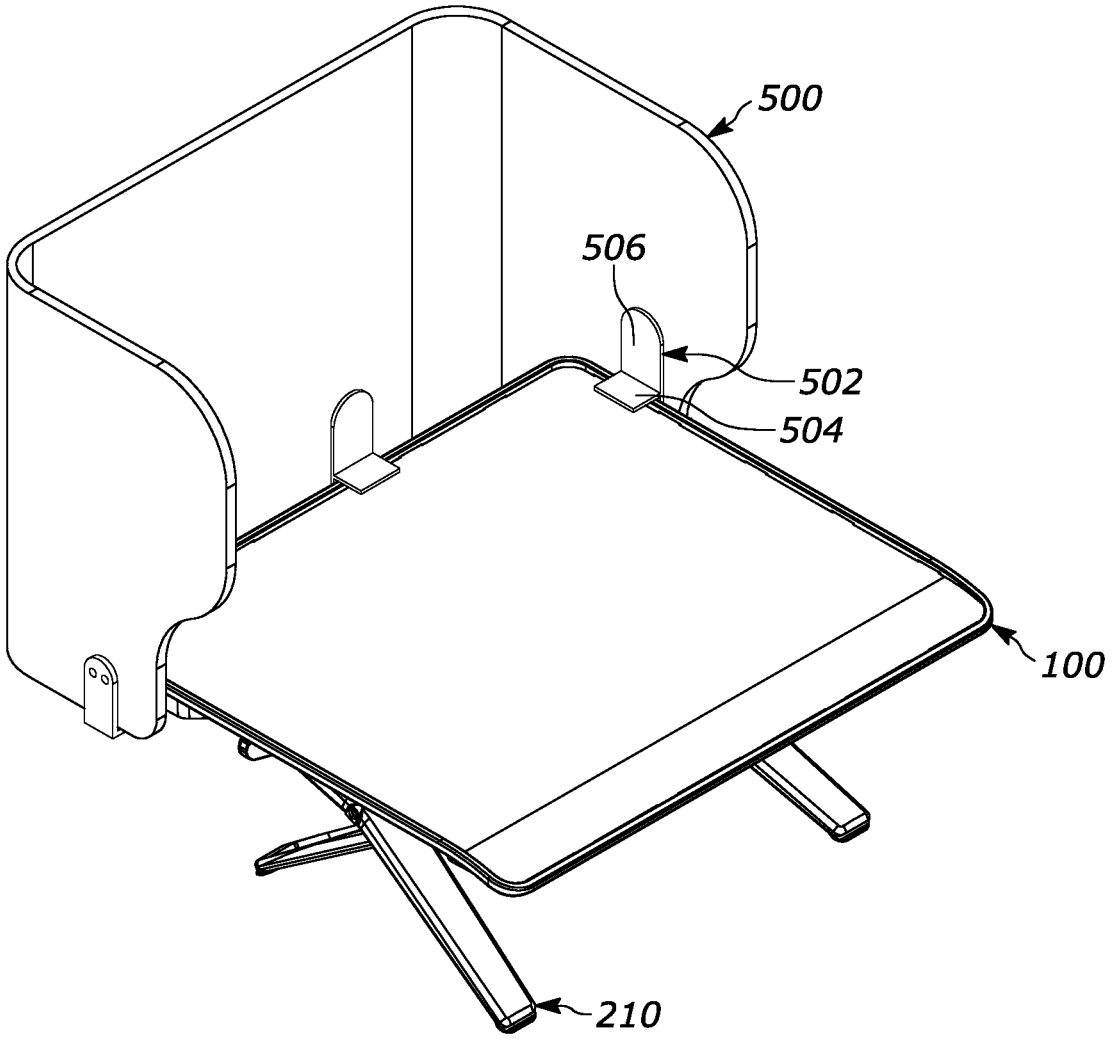
FIG. 26 is a top perspective view of a screen connected to the platform.
Figure 27:
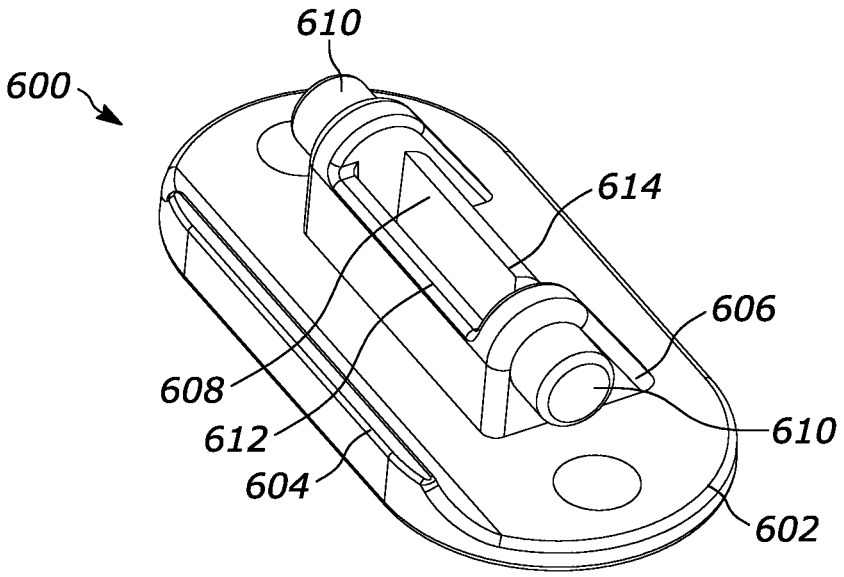
FIG. 27 is a front perspective view of a foot.
Figure 28:
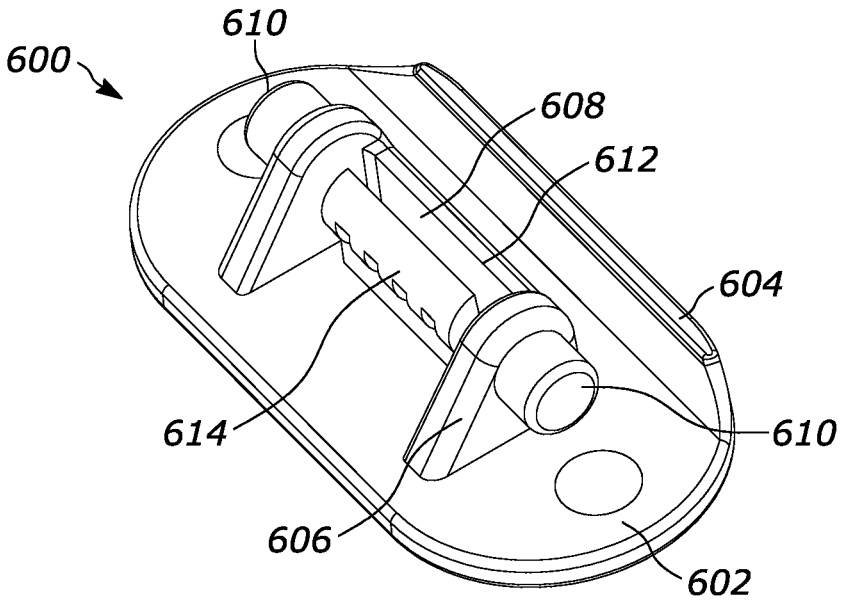
FIG. 28 is a rear perspective view of the foot.
Figure 29:
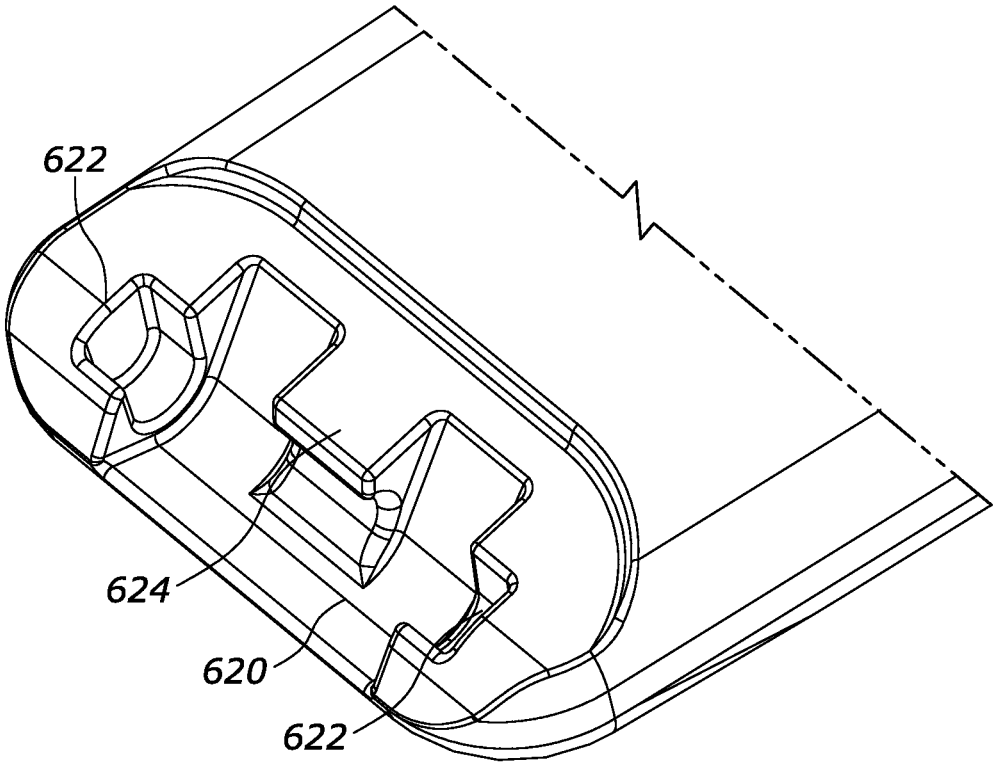
FIG. 29 is a partial view of a leg.
Figure 30:
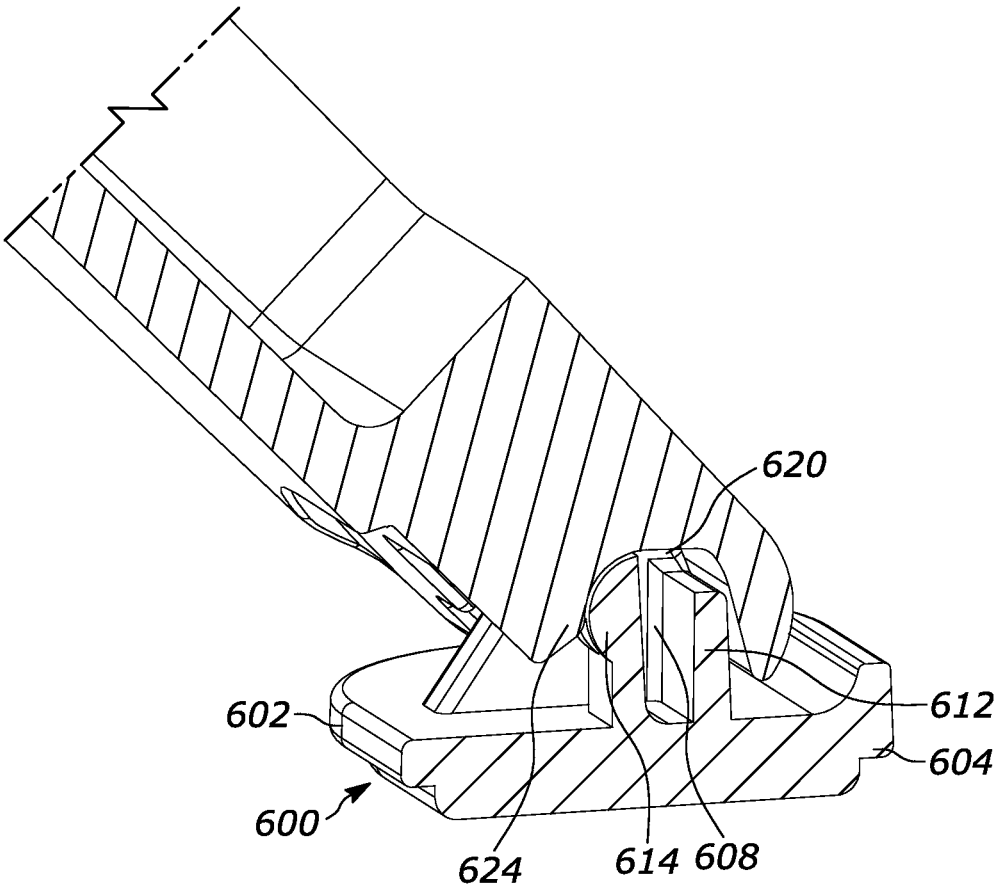
FIG. 30 is a sectional view of the foot connected to the leg.

FIG. 26 shows an example of a privacy screen 500 that can be connected to the platform 100 by a set of clips 502. Each of the clips 502 can include a pair of horizontal protrusions 504 and a pair of vertical protrusions 506 extending perpendicular to the one another. A first space is defined between the horizontal protrusions 504 for receiving the platform 100. A second space is defined between the vertical protrusions 506 for receiving the screen 500. As shown, the screen can be three-sided. Other sizes and configurations of screens 500 can also be used.

FIGS. 27-30 show an example of a foot 600 that can be pivotally connected to the leg members. The foot 600 includes a base 602 having a raised front edge 604. A connecting protrusion 606 extends from the base 602. The protrusion 606 includes a central clip 608 and a pair of side pins 610. The clip 608 includes a front wall 612 and a curved rear protrusion 614. In an exemplary embodiment, the foot 600 is integrally formed as a single-piece so that there are no separate hinge pins.

The legs can include a curved recessed portion 620 having a pair of side sockets 622. A rear over-hang 624 extends from the leg on one side of the recessed portion 620. The foot 600 is press fit or snap fit into the leg so that the pins 610 are positioned in the sockets 622. As the leg is moved from a raised to lower position, the over-hang 624 can rotate around the rear protrusion 614 and engage the clip 608 so that the foot 600 stays engaged with the leg.

In some embodiments, the front feet 600 can be equipped with first base pads 630 that include a material having a first friction coefficient (ie., a higher friction material such as rubber or another elastomer) and the rear feet 600 can be equipped with second base pads 632 that include a material having a second friction coefficient that is less than the first friction coefficient (i.e. low friction material such as felt or another fabric) as best shown in FIG. 2. Due to the difference in friction, when the platform 100 is height-adjusted, the front feet stay in a static position on the surface while the rear feet slide to accommodate the change. This can reduce the risk of the front feet accidentally sliding off the front of the support surface, and also to more effectively maintain a positional relationship between the front edge of the platform and the user. The first and second pads 630, 632 can be connected to the feet 600 using bonding or through a mechanical connection.

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present disclosure, and are not intended to limit the structure of the exemplary embodiments of the present disclosure to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A height adjustable work surface comprising:

a platform;

a height adjustment assembly moveably connected to the platform;

a leg assembly connected to the height adjustment assembly and moveably connected to the platform, wherein the leg assembly is moveable between a raised position, a lowered position, and at least one intermediate position; and a locking assembly moveably connected to the platform, the locking assembly configured to engage the height adjustment assembly to selectively secure the leg assembly in the raised position, the lowered position, and the at least one intermediate position, wherein the leg assembly includes a first leg and a second leg and wherein the height adjustment assembly includes a first slider connected to the first leg and a second slider connected to the second leg, wherein a first biasing mechanism is attached to the platform at a first end and attached to the first slider at a second end, and wherein a second biasing mechanism is attached to the platform at a first end and attached to the second slider at a second end.

2. The height adjustable work surface of claim 1, wherein the platform includes a main body having a base and a tray recessed from at least a portion of the base, and wherein at least a portion of the height adjustment mechanism is positioned between the tray and the base.

3. The height adjustable work surface of claim 2, wherein the platform includes an inner cover positioned over the tray and wherein an outer cover is positioned over the base.

4. The height adjustable work surface of claim 1, wherein the platform has a height that slopes toward the user.

5. The height adjustable work surface of claim 1, wherein the first slider includes a first set of teeth and the second slider includes a second set of teeth configured to align with the first set of teeth, and wherein the locking assembly includes a third set of teeth configured to engage the first set of teeth and the second set of teeth to secure the leg assembly in a selected position.

6. The height adjustable work surface of claim 5, wherein the first set of teeth and the second set of teeth are angled toward a distal portion of the platform and the third set of teeth are angled toward a proximal portion of the platform.

7. The height adjustable work surface of claim 1, wherein the first slider and the second slider translate relative to the platform.

8. The height adjustable work surface of claim 7, wherein the first leg is rotatably connected to the first slider and the second leg is rotatably connected to the second slider.

9. The height adjustable work surface of claim 1, wherein the first biasing mechanism and the second biasing mechanism bias the leg assembly to the raised position.

10. A height adjustable work surface comprising:

a platform;

a height adjustment assembly moveably connected to the platform;

a leg assembly connected to the height adjustment assembly and moveably connected to the platform, wherein the leg assembly is moveable between a raised position, a lowered position, and at least one intermediate position;

a locking assembly moveably connected to the platform, the locking assembly configured to engage the height adjustment assembly to selectively secure the leg assembly in the raised position;

a link rotatably connected to the leg assembly and rotatably connected to the platform, the link configured to support the platform through movement of the leg assembly; and a torsion spring positioned in the leg assembly and connected to a spring bracket, wherein the link is rotatably fixed to the spring bracket and wherein the torsion spring is configured to bias the link toward the raised position.

11. The height adjustable work surface of claim 10, wherein the locking assembly includes a first arm rotatably connected to the platform and a second arm rotatably connected to the platform.

12. The height adjustable work surface of claim 11, wherein the locking assembly includes a first biasing mechanism biasing the first arm to a locked position and a second biasing mechanism biasing the second arm to a locked position.

13. The height adjustable work surface of claim 10, wherein the leg assembly includes a first leg and a second leg and wherein the height adjustment assembly includes a first slider connected to the first leg and a second slider connected to the second leg.

14. A height adjustable work surface comprising:

a platform;

a height adjustment assembly moveably connected to the platform;

a leg assembly connected to the height adjustment assembly and moveably connected to the platform, wherein the leg assembly is moveable between a raised position, a lowered position, and at least one intermediate position;

a locking assembly moveably connected to the platform, the locking assembly configured to engage the height adjustment assembly to selectively secure the leg assembly in the raised position; and a lower position lock configured to releasably secure the leg assembly inside of the platform in the lowered position, wherein the platform includes a main body having a base and a tray recessed from at least a portion of the base, wherein at least a portion of the height adjustment assembly is positioned between the tray and the base, and wherein the platform includes an inner cover positioned over the tray and wherein the outer cover is positioned over the base.

15. The height adjustable work surface of claim 14, wherein the lower position lock includes a protrusion extending from the leg assembly and recessed tab formed in the locking assembly, wherein the protrusion includes a hook configured to releasably engage the recessed tab.

16. The height adjustable work surface of claim 14, wherein in the lowered position the leg assembly is positioned in a cavity in the platform.

17. The height adjustable work surface of claim 14, further comprising a front foot pivotally connected to the leg assembly and a rear foot pivotally connected to the leg assembly, and wherein a first pad is connected to the front foot and a second pad is connected to the rear foot, and wherein the first pad includes a material having a first friction coefficient and the second pad includes a material having a second friction coefficient less than the first friction coefficient.

18. The height adjustable work surface of claim 14, wherein the leg assembly includes a first leg and a second leg and wherein the height adjustment assembly includes a first slider connected to the first leg and a second slider connected to the second leg.

* * * * *